US008450606B2

(12) United States Patent
McNutt et al.

(10) Patent No.: US 8,450,606 B2
(45) **Date of Patent: *May 28, 2013**

(54) COMMUNICATION CABLE HAVING ELECTRICALLY ISOLATED SHIELD PROVIDING ENHANCED RETURN LOSS

(75) Inventors: Christopher W. McNutt, Woodstock, GA (US); James S. Tyler, Woodstock, GA (US); Michael Klepper, Hoisington, KS (US); Delton C. Smith, Abbeville, SC (US); Jörg-Hein Walling, Beaconsfield (CA)

(73) Assignee: Superior Essex Communication LP, Atlanta, GA (US)

( * ) Notice: Subject to any disclaimer, the term of this patent is extended or adjusted under 35 U.S.C. 154(b) by 557 days.

This patent is subject to a terminal disclaimer.

(21) Appl. No.: 12/653,804

(22) Filed: Dec. 18, 2009

(65) Prior Publication Data

US 2010/0101853 A1 Apr. 29, 2010

Related U.S. Application Data

(63) Continuation-in-part of application No. 12/313,914, filed on Nov. 25, 2008, now Pat. No. 7,923,641, which is a continuation-in-part of application No. 11/502,777, filed on Aug. 11, 2006, now abandoned.

(60) Provisional application No. 61/203,303, filed on Dec. 19, 2008.

(51) Int. Cl.
*H01B 7/00* (2006.01)

(52) U.S. Cl.
USPC ..... 174/36

(58) Field of Classification Search
USPC ..... 173/36, 106 R, 113 R
See application file for complete search history.

(56) References Cited

U.S. PATENT DOCUMENTS

| | | | |
|---|---|---|---|
| 3,373,475 | A | 3/1968 | Petersen |
| 4,604,497 | A | 8/1986 | Bell et al. |

(Continued)

FOREIGN PATENT DOCUMENTS

| | | | |
|---|---|---|---|
| GB | 2432963 | * | 6/2007 |
| JP | 2000-90748 | * | 3/2000 |
| JP | 2006-173044 | * | 6/2006 |
| WO | WO2006105166 | | 10/2006 |

OTHER PUBLICATIONS

"Product Catalogue" 2 pgs., Enterprise Cabling R&M, May 2006.

(Continued)

*Primary Examiner* — Chau Nguyen

(57) ABSTRACT

A tape can comprise a strip of dielectric material, with adhering patches of electrical conductive material. The patches can be substantially electrically isolated from one another. The strip can be disposed in a communication cable to provide a shield that is electrically discontinuous or has high resistance between opposite cable ends. Each patch can interact with electromagnetic radiation associated with electrical signals transmitting over the cable. The patches can collectively interact with the transmitting electrical signals in a cumulative or resonant manner to produce a spike in return loss at a particular frequency of the transmitting signals. The frequency location of the spike can depend upon the sizes of the patches, with size impacting manufacturability. The patches can be sized such that the spike falls within an operating frequency of the transmitting signal but is suppressed, so the cable meets return loss specifications while offering manufacturing advantage.

44 Claims, 13 Drawing Sheets

U.S. PATENT DOCUMENTS

| | | | | |
|---|---|---|---|---|
| 4,638,272 | A | 1/1987 | Ive | |
| 5,006,806 | A | 4/1991 | Rippingale | |
| 5,106,175 | A | 4/1992 | Davis et al. | |
| 5,114,517 | A | 5/1992 | Rippingale et al. | |
| 5,956,445 | A * | 9/1999 | Deitz et al. | 385/100 |
| 6,687,437 | B1 | 2/2004 | Starnes et al. | |
| 6,737,574 | B2 | 5/2004 | Sylyvia et al. | |
| 6,770,819 | B2 | 8/2004 | Patel | |
| 6,850,161 | B1 | 2/2005 | Elliott | |
| 7,173,189 | B1 | 2/2007 | Hazy et al. | |
| 7,332,676 | B2 | 2/2008 | Sparrowhawk | |
| 7,335,837 | B2 | 2/2008 | Pfeiler et al. | |
| 7,923,641 | B2 * | 4/2011 | Smith et al. | 174/113 R |
| 8,119,906 | B1 * | 2/2012 | Smith et al. | 174/36 |
| 2006/0048961 | A1 | 3/2006 | Pfeiler et al. | |
| 2007/0037419 | A1 | 2/2007 | Sparrowhawk | |
| 2007/0224495 | A1 * | 9/2007 | Gibbons et al. | 429/144 |
| 2008/0314636 | A1 * | 12/2008 | Ogura | 174/350 |

OTHER PUBLICATIONS

"Draka" 12 pgs., Draka Comteq, Cable Solutions, Data cables, Sep. 27, 2006.

"10 Gigabit Ethernet Solutions" 8 pgs., R&M Convincing Cabling Solutions.

Wetzikon, "R&M: The Rising Stars in Copper Cabling" 2 pgs., Sep. 1, 1005.

"R&M Star Real 10" 2 pgs., Mar. 2006.

"Connections 29" 36 pgs., Sep. 2005.

* cited by examiner

COMMUNICATION CABLE HAVING ELECTRICALLY ISOLATED SHIELD PROVIDING ENHANCED RETURN LOSS

CROSS REFERENCE TO RELATED APPLICATIONS

This application claims priority to U.S. Provisional Patent Application No. 61/203,303, filed on Dec. 19, 2008 in the name of Christopher McNutt et al. and entitled "Communication Cable Having Electrically Isolated Shield Providing Enhanced Return Loss," and is a continuation-in-part of and claims priority to co-assigned U.S. patent application Ser. No. 12/313,914 filed on Nov. 25, 2008 now U.S. Pat. No. 7,923,641 in the name of Delton C. Smith et al. and entitled "Communication Cable Comprising Electrically Isolated Patches of Shielding Material," which claims priority as a continuation-in-part of co-assigned U.S. patent application Ser. No. 11/502,777, filed Aug. 11, 2006 now abandoned in the name of Delton C. Smith et al. and entitled "Method and Apparatus for Fabricating Noise-Mitigating Cable." The entire contents of each of the patent applications identified above are hereby incorporated herein by reference.

This application is related to the co-assigned U.S. patent application entitled "Communication Cable Comprising Electrically Discontinuous Shield Having Nonmetallic Appearance" filed on Nov. 25, 2008 and assigned U.S. patent application Ser. No. 12/313,910, the entire contents of which are hereby incorporated herein by reference.

This application is related to the co-assigned U.S. patent application entitled "Communication Cable Shielded With Mechanically Fastened Shielding Elements" filed on Aug. 26, 2009 and assigned U.S. patent application Ser. No. 12/583,797, the entire contents of which are hereby incorporated herein by reference.

This application is related to the co-assigned U.S. patent application entitled "Communication Cable With Electrically Isolated Shield Comprising Holes" filed on Sep. 10, 2009 assigned U.S. patent application Ser. No. 12/584,672, the entire contents of which are hereby incorporated herein by reference.

FIELD OF THE TECHNOLOGY

The present invention relates to communication cables that are shielded from electromagnetic radiation and more specifically to a communication cable shielded with patches of conductive material adhering to a dielectric film that is wrapped around wires of the cable.

BACKGROUND

As the desire for enhanced communication bandwidth escalates, transmission media need to convey information at higher speeds while maintaining signal fidelity and avoiding crosstalk, including alien crosstalk. However, effects such as noise, interference, crosstalk, alien crosstalk, and/or alien elfext crosstalk can strengthen with increased data rates, thereby degrading signal quality or integrity. For example, when two cables are disposed adjacent one another, data transmission in one cable can induce signal problems in the other cable via crosstalk interference.

One approach to addressing crosstalk between communication cables is to circumferentially encase each cable in a continuous shield, such as a flexible metallic tube or a foil that coaxially surrounds the cable's conductors. However, shielding based on convention technology can be expensive to manufacture and/or cumbersome to install in the field. In particular, complications can arise when a cable is encased by a shield that is electrically continuous between the two ends of the cable.

In a typical application, each cable end is connected to a terminal device such as an electrical transmitter, receiver, or transceiver. The continuous shield can inadvertently carry voltage along the cable, for example from one terminal device at one end of the cable towards another terminal device at the other end of the cable. If a person contacts the shielding, the person may receive a shock if the shielding is not properly grounded. Accordingly, continuous cable shields are typically grounded at both ends of the cable to reduce shock hazards and loop currents that can interfere with transmitted signals.

Such a continuous shield can also set up standing waves of electromagnetic energy based on signals received from nearby energy sources. In this scenario, the shield's standing wave can radiate electromagnetic energy, somewhat like an antenna, that may interfere with wireless communication devices or other sensitive equipment operating nearby.

Accordingly, to address these representative deficiencies in the art, what is needed is an improved capability for shielding conductors that may carry high-speed communication signals. Another need exists for technology for efficiently manufacturing communication cables that are resistant to noise. Yet another need exists for a cable construction that is manufacturable, that provides suitable return loss performance, and that effectively suppresses crosstalk and/or other interference without providing an electrically conductive path between opposite ends of the cable. A capability addressing one or more of such needs would support increasing bandwidth without unduly increasing cost or installation complexity.

SUMMARY

The present invention supports providing shielding for cables that may communicate data or other information.

In one aspect of the present invention, a tape can comprise a narrow strip of dielectric material, for example in the form of a film. Electrically conductive areas or patches can be disposed against one or both sides of the tape, with the conductive patches electrically isolated from one another. As an alternative to full electrical isolation, the patches can be in electrical communication with one another via one or more high resistance paths. The patches can comprise aluminum, copper, a metallic substance, or some other material that readily conducts electricity. The patches can be printed, fused, transferred, bonded, vapor deposited, imprinted, coated, fastened, stapled, embossed, pressed, punched, or otherwise attached to or disposed adjacent to the strip of dielectric material. The tape can be wrapped around signal conductors, such as wires that transmit data, to provide electrical or electromagnetic shielding for the conductors. The tape can be a shield that is electrically discontinuous or exhibits a high level of resistance between opposite ends of a cable. While electricity can flow freely in each individual patch, the isolating gaps can provide shield discontinuities or high resistance paths for inhibiting electricity from flowing freely in the tape along the full length of the cable.

The patches can be sized or dimensioned to facilitate manufacturing, for example each patch being at least about 1.5 meters in length with the spacing between adjacent patches being at least about 1.5 millimeters. The cable can operate across a range of signal frequencies in connection with transmitting data or information. The patches can resonant, or setup a standing wave of electrical or electromagnetic interaction, that produces a spike in return loss. The patches can be sized so that the return loss spike is located within the cable's operating frequency range, but is suppressed to avoid compromising a return loss specification.

The discussion of shielding conductors presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

BRIEF DESCRIPTION OF THE DRAWINGS

FIG. 3, are a flowchart depicting an exemplary process for manufacturing cable in accordance with certain embodiments of the present invention.

FIG. 4, are illustrations of exemplary segmented tapes comprising conductive patches disposed on opposite sides of a dielectric film in accordance with certain embodiments of the present invention.

FIG. 5, are illustrations, from different viewing perspectives, of an exemplary segmented tape comprising conductive patches disposed on opposite sides of a dielectric film in accordance with certain embodiments of the present invention.

Figure 1A:
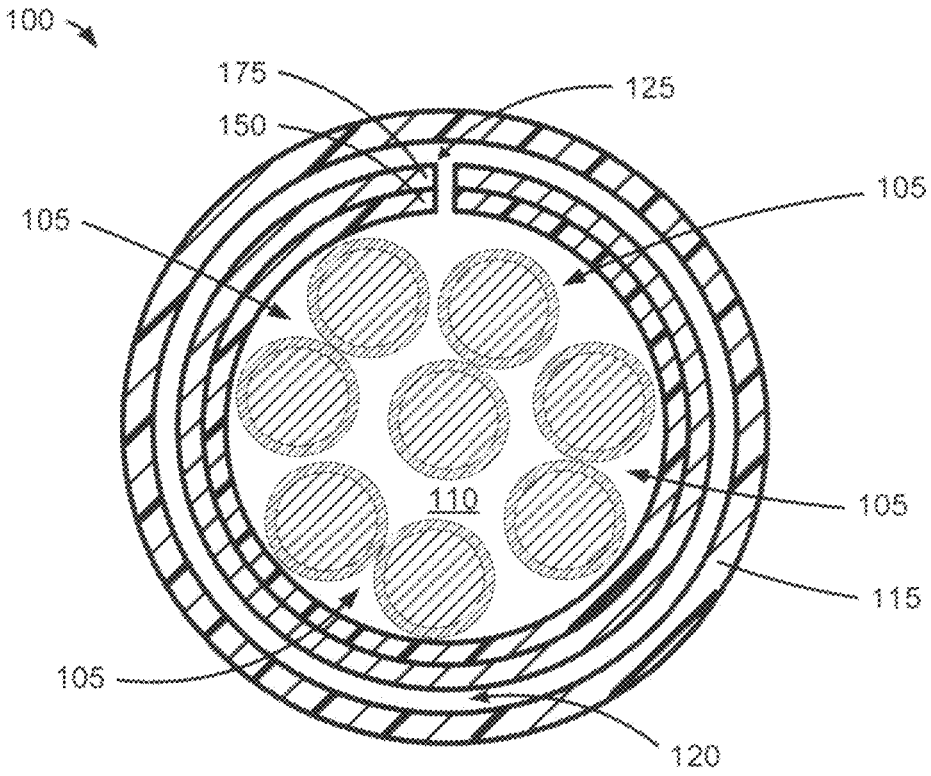
FIG. 1A is a cross sectional view of an exemplary communication cable that comprises a segmented shield in accordance with certain embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports shielding a communication cable, wherein at least one break or discontinuity in a shielding material electrically isolates shielding at one end of the cable from shielding at the other end of the cable. As an alternative to forming a continuous or contiguous conductive path, the tape can be segmented or can comprise intermittently conductive patches or areas.

Figure 1B:
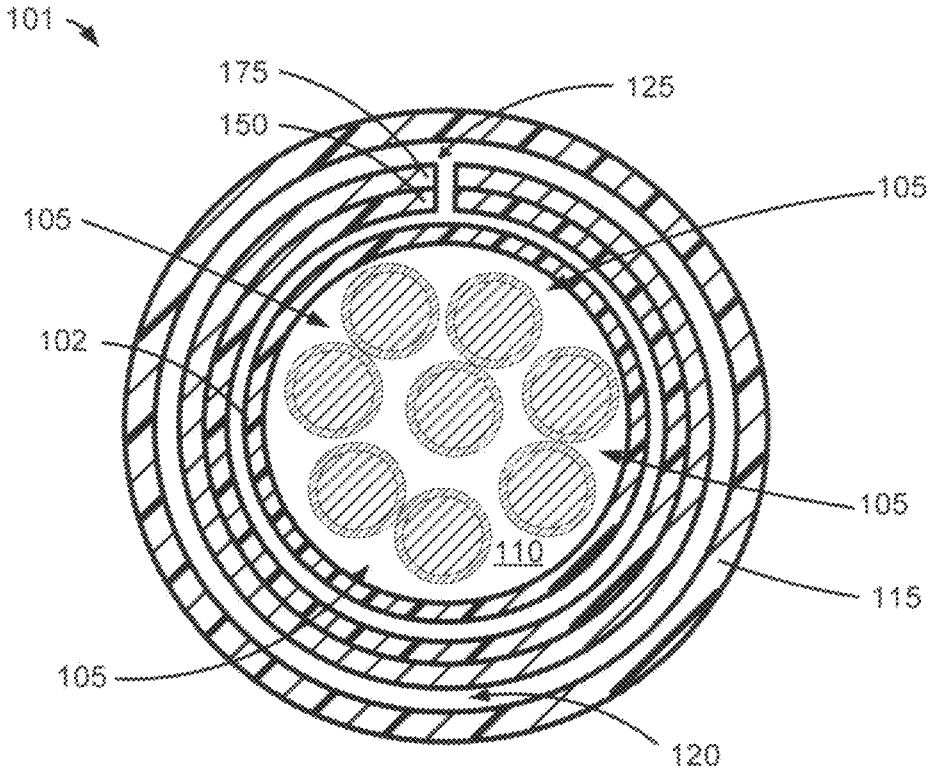
FIGS. 1B and 1C are cross sectional views of exemplary communication cables that comprise segmented shields in accordance with certain embodiments of the present invention.
Figure 1C:
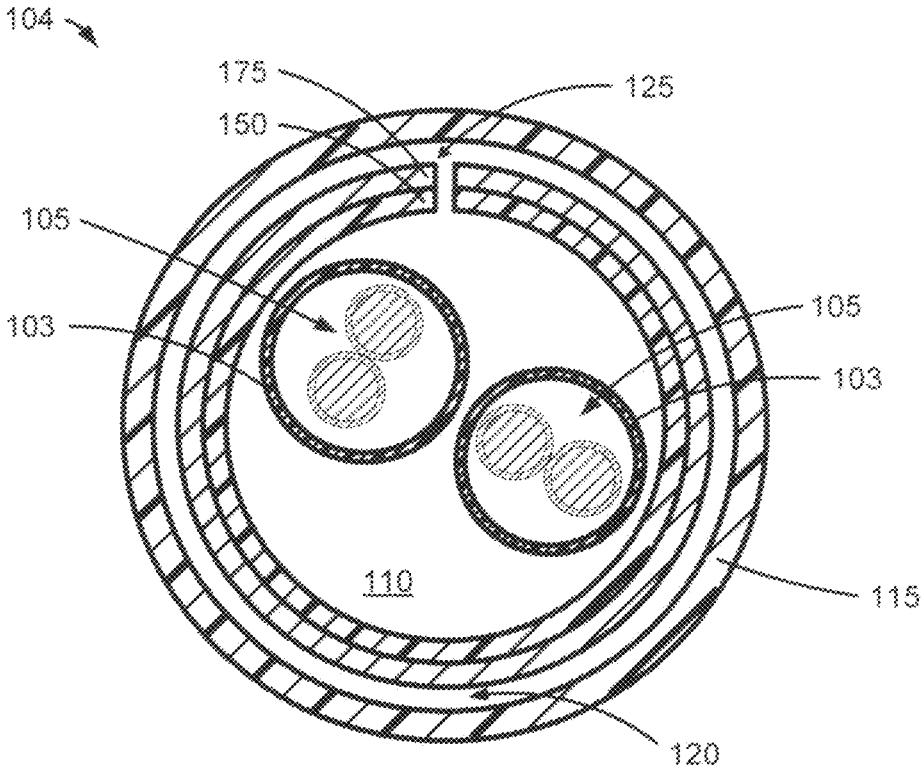
Figure 7A:
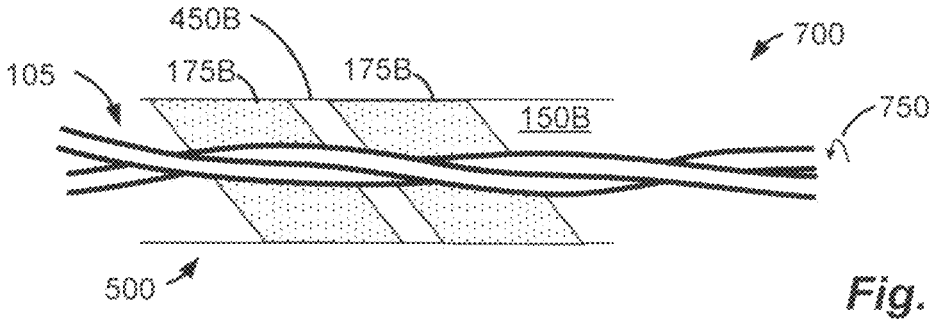
FIG. 7A is an illustration of an exemplary orientation for conductive patches of a segmented tape with respect to a twisted pair of conductors in accordance with certain embodiments of the present invention.
Figure 8A:
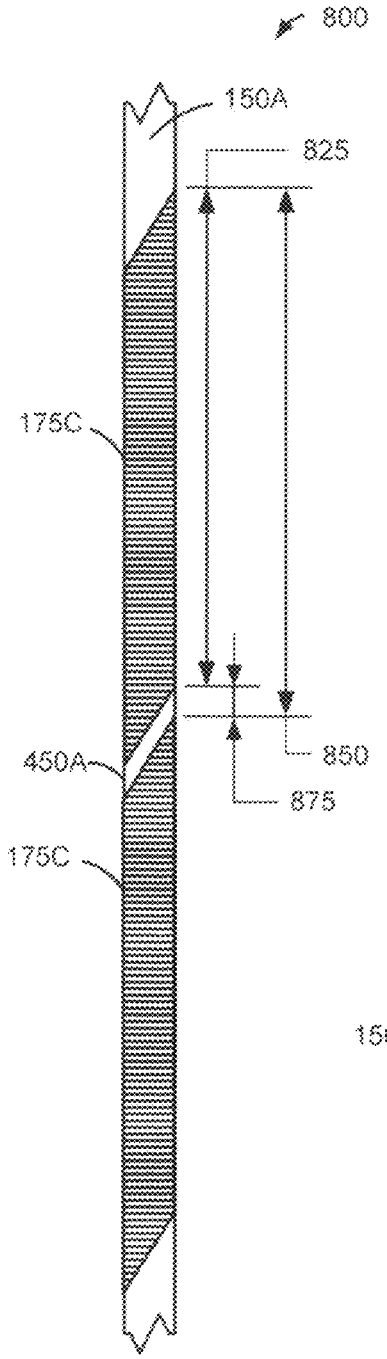
FIG. 8A is an illustration of an exemplary segmented tape in accordance with certain embodiments of the present invention.
Figure 8B:
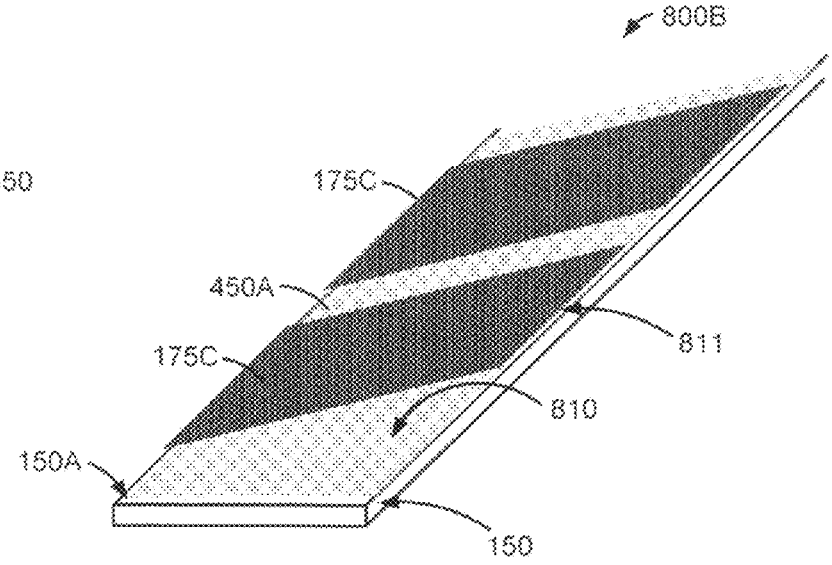
FIG. 8B is an illustration of an exemplary segmented tape comprising metallization in accordance with certain embodiments of the present invention.
Figure 9A:
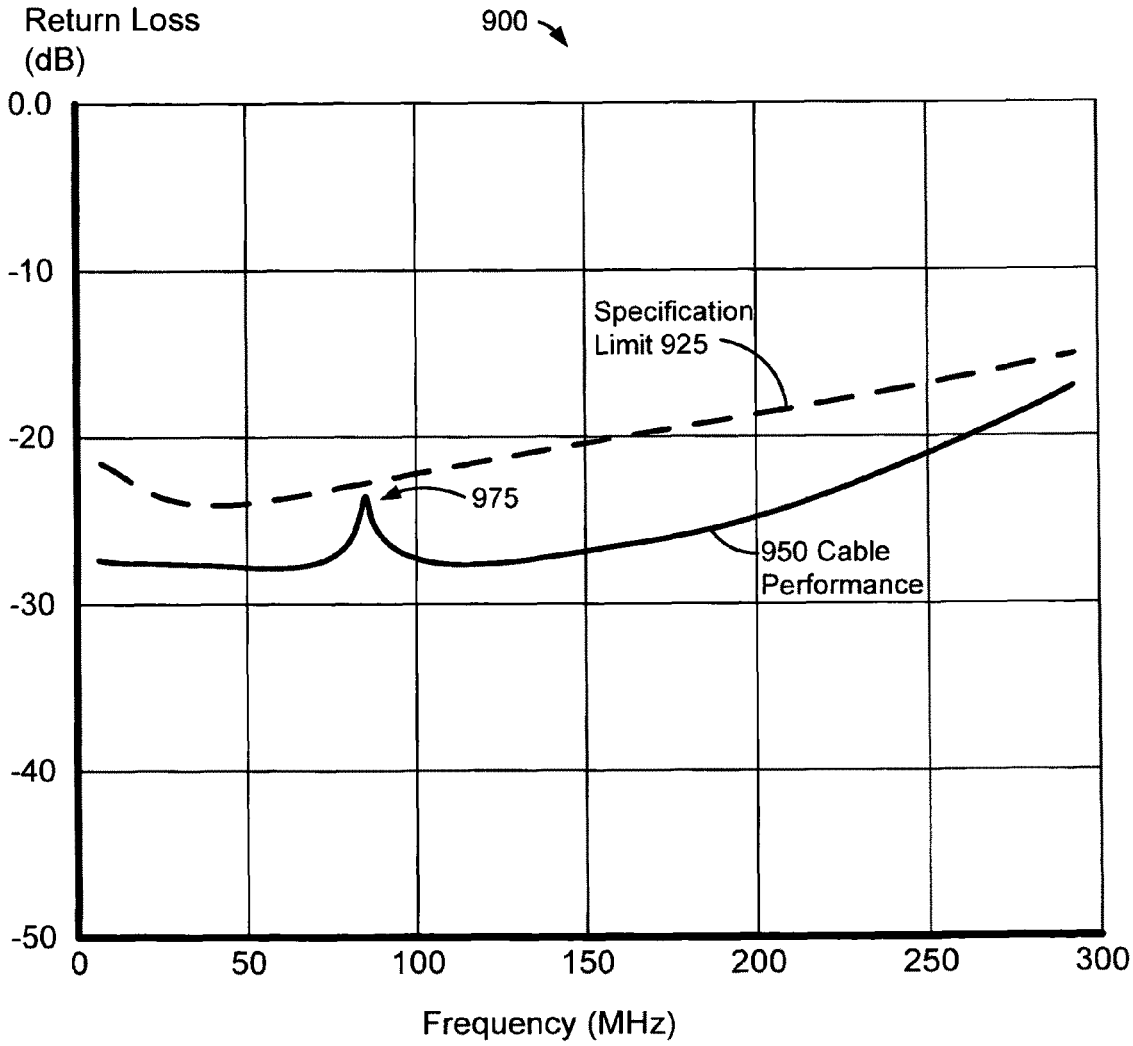
FIGS. 9A, 9B, and 9C are three exemplary plots of return loss as a function of frequency in accordance with certain exemplary embodiments of the present invention.
Figure 9B:
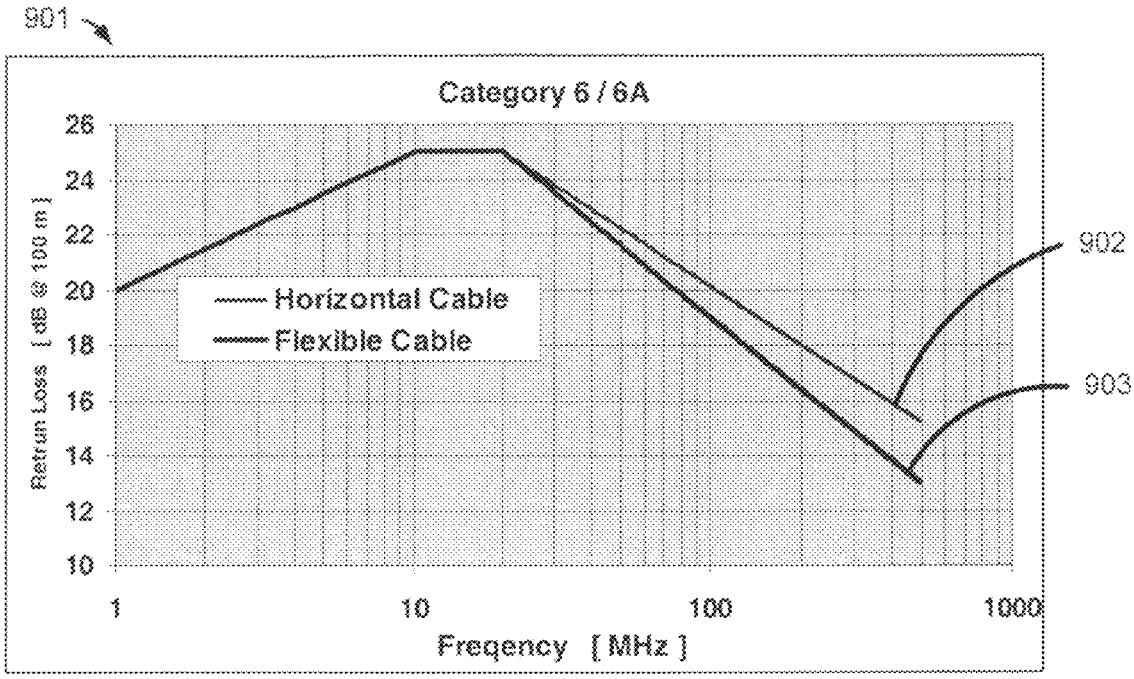
Figure 9C:
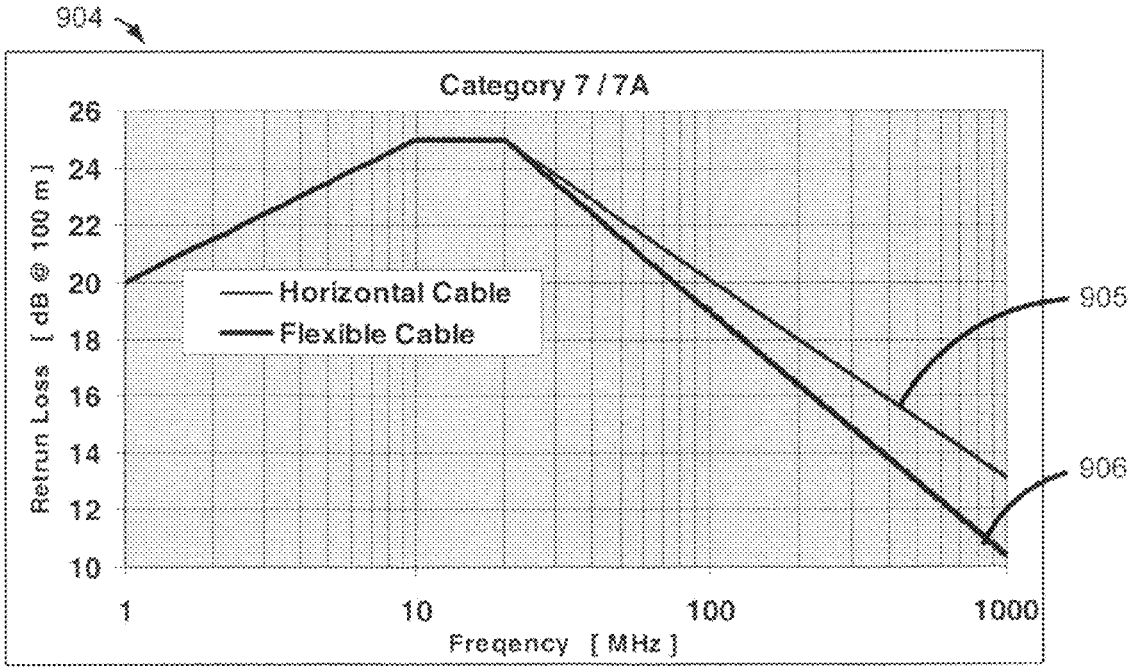

Cables comprising segmented tapes, and technology for making such cables, will now be described more fully hereinafter with reference to FIGS. 1-9, which describe representative embodiments of the present invention. In an exemplary embodiment, the segmented tape can be characterized as shielding tape or as tape with segments or patches of conductive material. FIGS. 1A, 1B, and 1C provide end-on views of cables comprising segmented tape. FIGS. 2A, 2B, 4, 5, and 6 illustrate representative segmented tapes. FIG. 2C depicts wrapping segmented tape around or over conductors. FIG. 3 offers a process for making cable with segmented shielding. FIG. 7 describes orientations of patches in cables. FIG. 8A illustrates a segmented tape comprising patches that are sized to promote manufacturability. FIG. 8B illustrates a segmented tape comprising a high resistance path that supports limited electrical communication among patches. FIGS. 9A, 9B, and 9C illustrate cable return loss plots.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIG. 1A, this figure illustrates a cross sectional view of a communication cable 100 that comprises a segmented shield 125 according to certain exemplary embodiments of the present invention.

The core 110 of the cable 100 contains four pairs of conductors 105, four being an exemplary rather than limiting number. Each pair 105 can be a twisted pair that carries data, for example in a range of 1-10 Gbps or some other appropriate range. The pairs 105 can each have the same twist rate (twists-per-meter or twists-per-foot) or may be twisted at different rates.

The core 110 can be hollow as illustrated or alternatively can comprise a gelatinous, solid, or foam material, for example in the interstitial spaces between the individual conductors 105. In one exemplary embodiment, one or more members can separate each of the conductor pairs 105 from the other conductor pairs 105. For example, the core 110 can contain an extruded or pultruded separator that extends along the cable 110 and that provides a dedicated cavity or channel for each of the four conductor pairs 105. Viewed end-on or in cross section, the separator could have a cross-shaped geometry or an x-shaped geometry.

Such an internal separator can increase physical separation between each conductor pair 105 and can help maintain a random orientation of each pair 105 relative to the other pairs 105 when the cable 100 is field deployed.

A segmented tape 125 surrounds and shields the four conductor pairs 105. As discussed in further detail below, the segmented tape 125 comprises a dielectric substrate 150 with patches 175 of conductive material attached thereto. As illustrated, the segmented tape 125 extends longitudinally along the length of the cable 100, essentially running parallel with and wrapping over the conductors 105.

In an alternative embodiment, the segmented tape 125 can wind helically or spirally around the conductor pairs 105. More generally, the segmented tape 125 can circumferentially cover, house, encase, or enclose the conductor pairs 105. Thus, the segmented tape 125 can circumscribe the conductors 105, to extend around or over the conductors 105. Although FIG. 1A depicts the segmented tape 125 as partially circumscribing the conductors 105, that illustrated geometry is merely one example. In many situations, improved blockage of radiation will result from overlapping the segmented tape 125 around the conductors 105, so that the segmented tape fully circumscribes the conductors 105. Moreover, in certain embodiments, the side edges of the segmented tape 125 can essentially butt up to one another around the core 110 of the cable 100. Further, in certain embodiments, a significant gap can separate these edges, so that the segmented tape 125 does not fully circumscribe the core 110.

In one exemplary embodiment, one side edge of the segmented tape 125 is disposed over the other side edge of the tape 125. In other words, the edges can overlap one another, with one edge being slightly closer to the center of the core 110 than the other edge.

An outer jacket 115 of polymer seals the cable 110 from the environment and provides strength and structural support. The jacket 115 can be characterized as an outer sheath, a jacket, a casing, or a shell. A small annular spacing 120 may separate the jacket 115 from the segmented tape 125. In certain exemplary embodiments, the segmented tape 125 is bonded to the outer jacket 115.

In one exemplary embodiment, the cable 100 or some other similarly noise mitigated cable can meet a transmission requirement for "10 G Base-T data com cables." In one exemplary embodiment, the cable 100 or some other similarly noise mitigated cable can meet the requirements set forth for 10 Gbps transmission in the industry specification known as ANSI/TIA 568-C.2 and/or the industry specification known as ISO 11801. Accordingly, the noise mitigation that the segmented tape 125 provides can help one or more twisted pairs of conductors 105 transmit data at 10 Gbps or faster without unduly experiencing bit errors or other transmission impairments. As discussed in further detail below, an automated and scalable process can fabricate the cable 100 using the segmented tape 125.

FIGS. 1B and 1C illustrate alternative cable embodiments. The exemplary cable 101 illustrated in FIG. 1B comprises a tape 102 disposed between the segmented tape 125 and the conductors 105 and formed around the conductors 105. In an exemplary embodiment, the tape 102 can comprise (or consist of) a strip of polyester, plastic, polymer, electrically insulating, or dielectric material. In certain exemplary embodiments, the tape 102 comprises a second segmented tape.

The exemplary cable 104 illustrated in FIG. 1C comprises two tapes 103, each formed around a respective pair of conductors 105. In an exemplary embodiment, each of the tapes 103 can comprise (or consist of) a strip of polyester, plastic, polymer, electrically insulating, or dielectric material. In certain exemplary embodiments, one or both of the tapes 103 comprises a second segmented tape.

Figure 2A:
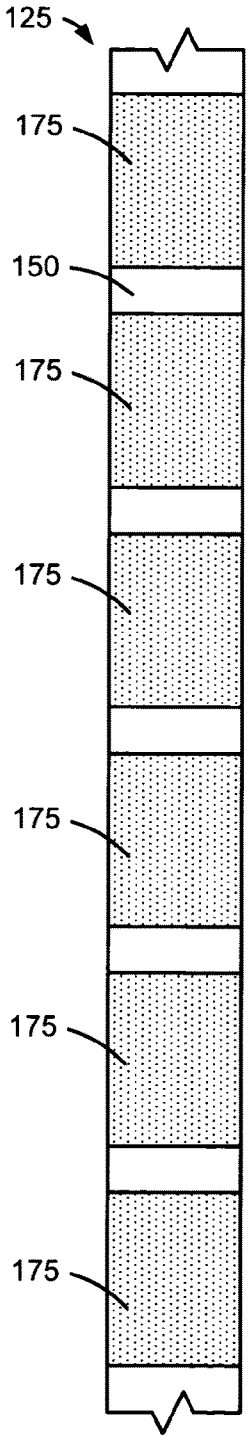
FIGS. 2A and 2B are, respectively, overhead and cross sectional views of an exemplary segmented tape that comprises a pattern of conductive patches attached to a dielectric film substrate in accordance with certain embodiments of the present invention.
Figure 2B:
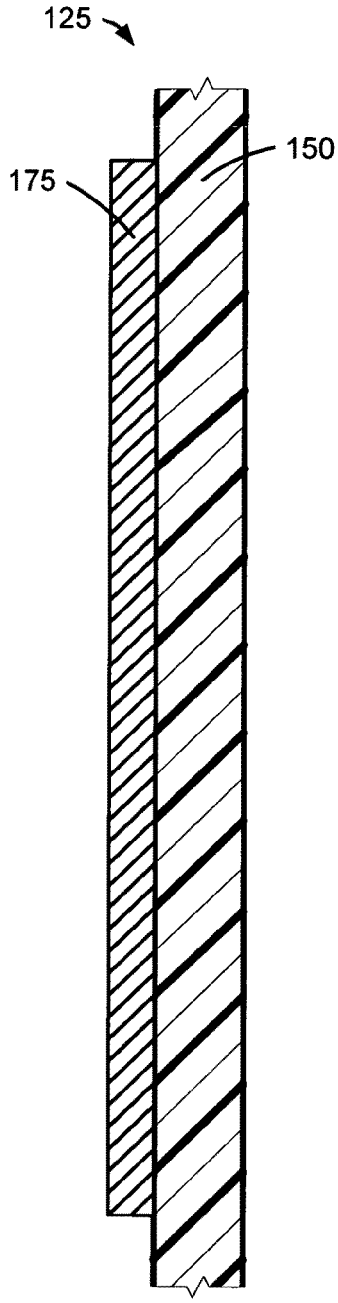
Figure 2C:
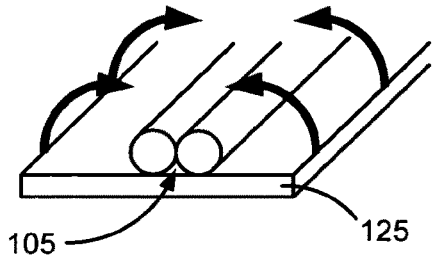
FIG. 2C is an illustration of an exemplary technique for wrapping a segmented tape lengthwise around a pair of conductors in accordance with certain embodiments of the present invention.
Figure 3A:
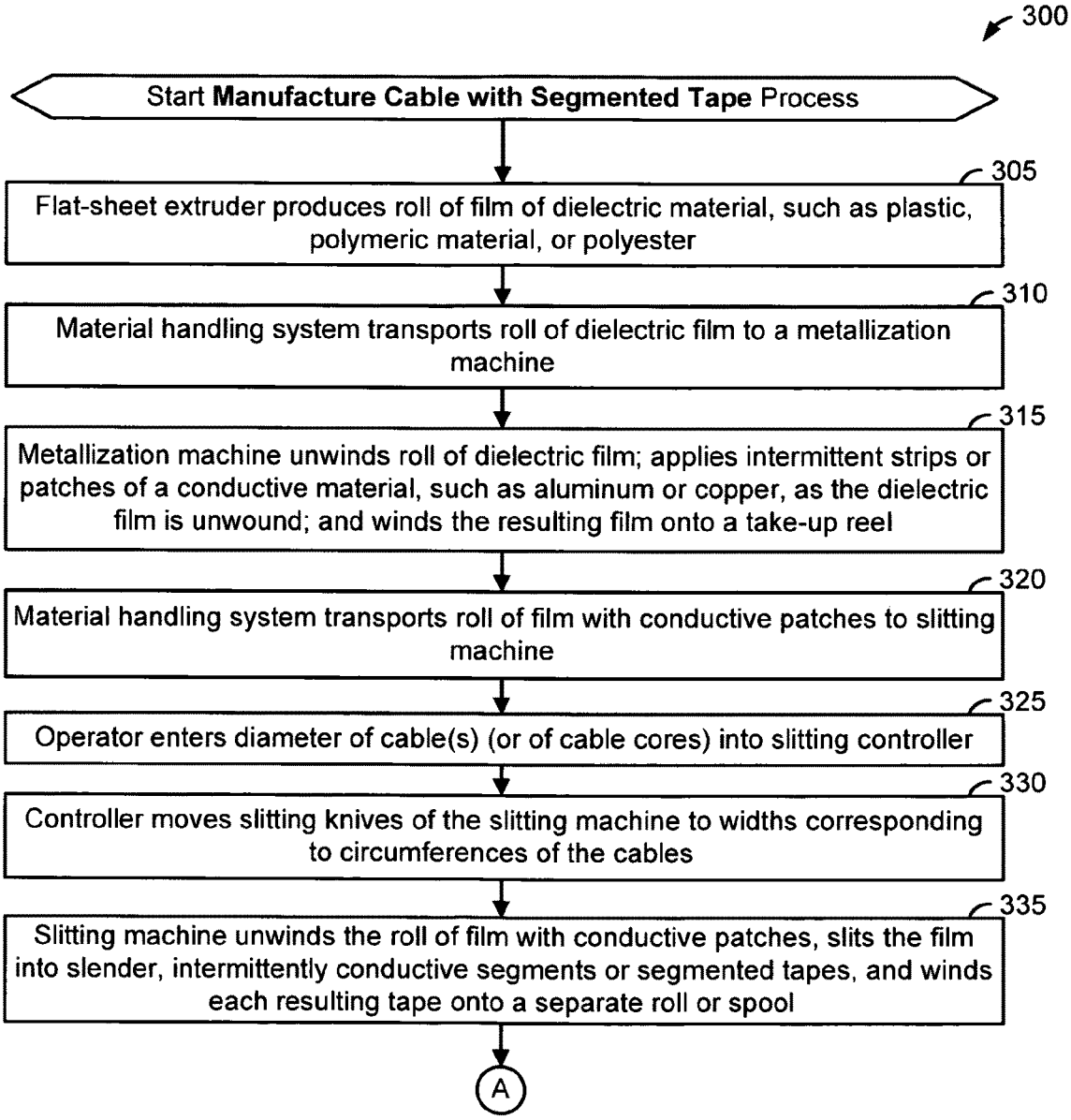
FIGS. 3A and 3B, collectively
Figure 3B:
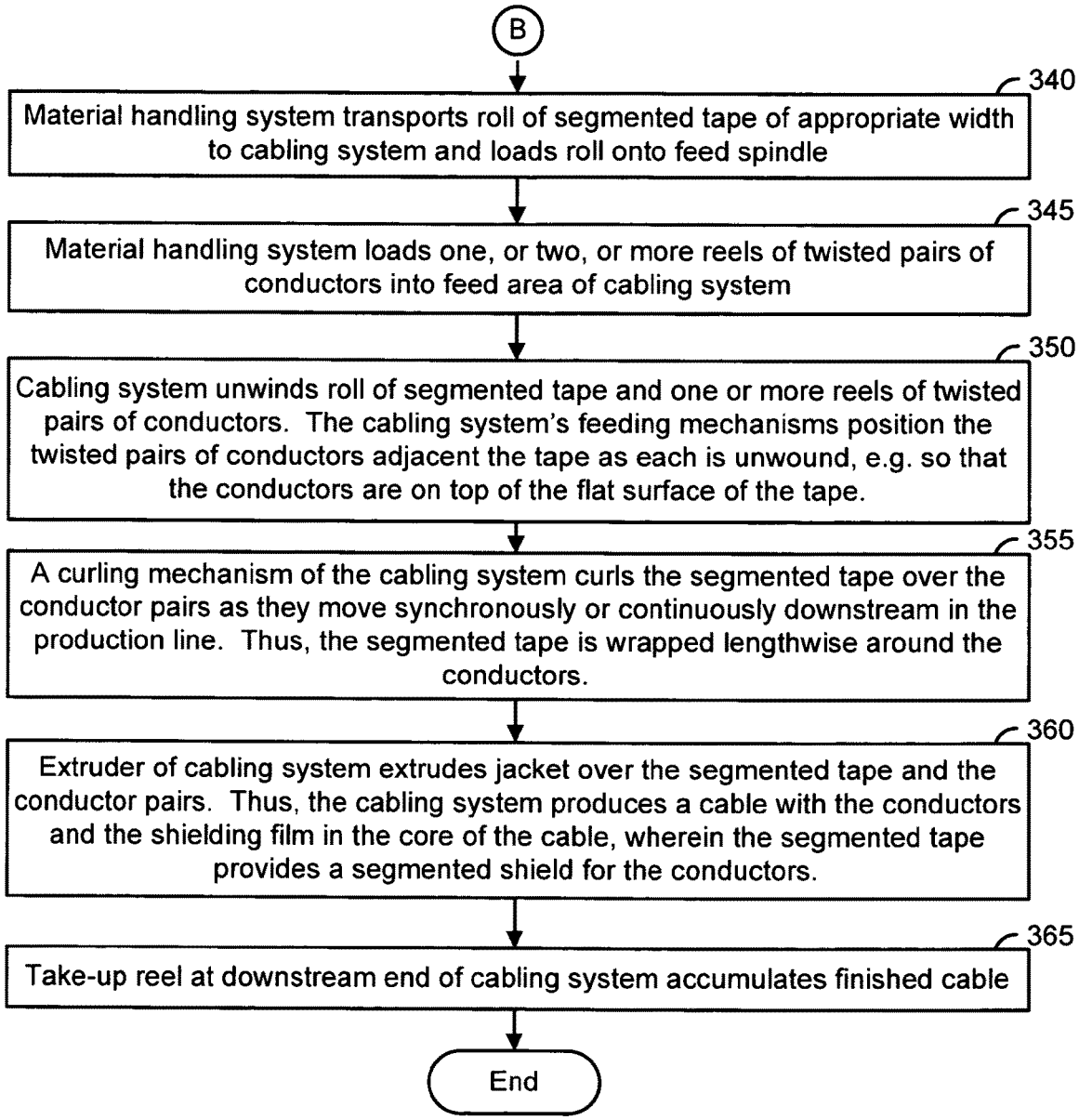

Turning now to FIGS. 2A and 2B, these figures respectively illustrate overhead and cross sectional views of a segmented tape 125 that comprises a pattern of conductive patches 175 attached to a dielectric substrate 150 according to certain exemplary embodiments of the present invention. That is, FIGS. 2A and 2B depict an exemplary embodiment of the segmented tape 125 shown in FIGS. 1A, 1B, and 1C and discussed above. More specifically, FIGS. 1A, 1B, and 1C each illustrates a cross sectional cable view wherein the cross section cuts through one of the conductive patches 175, perpendicular to the major axis of the segmented tape 125.

The segmented tape 125 comprises a dielectric substrate film 150 of flexible dielectric material that can be wound around and stored on a spool. That is, the illustrated section of segmented tape 125 can be part of a spool of segmented tape 125. The film can comprise a polyester, polypropylene, polyethylene, polyimide, or some other polymer or dielectric material that does not ordinarily conduct electricity. That is, the segmented tape 125 can comprise a thin strip of pliable material that has at least some capability for electrical insulation. In one exemplary embodiment, the pliable material can comprise a membrane or a deformable sheet. In one exemplary embodiment, the substrate is formed of the polyester material sold by E.I. DuPont de Nemours and Company under the registered trademark MYLAR.

The conductive patches 175 can comprise aluminum, copper, nickel, iron, or some metallic alloy or combination of materials that readily transmits electricity. The individual patches 175 can be separated from one another so that each patch 175 is electrically isolated from the other patches 175. That is, the respective physical separations between the patches 175 can impede the flow of electricity between adjacent patches 175.

The conductive patches 175 can span fully across the segmented tape 125, between the tape's long edges. As discussed in further detail below, the conductive patches 175 can be attached to the dielectric substrate 150 via gluing, bonding, adhesion, printing, painting, welding, coating, heated fusion, melting, or vapor deposition, to name a few examples.

In one exemplary embodiment, the conductive patches 175 can be over-coated with an electrically insulating film, such as a polyester coating (not shown in FIGS. 2A and 2B). In one exemplary embodiment, the conductive patches 175 are sandwiched between two dielectric films, the dielectric substrate 150 and another electrically insulating film (not shown in FIGS. 2A and 2B).

The segmented tape 125 can have a width that corresponds to the circumference of the core 110 of the cable 100. The width can be slightly smaller than, essentially equal to, or larger than the core circumference, depending on whether the longitudinal edges of the segmented tape 125 are to be separated, butted together, or overlapping, with respect to one another in the cable 100.

In one exemplary embodiment, the dielectric substrate 150 has a thickness of about 1-5 mils (thousandths of an inch) or about 25-125 microns. Each conductive patch 175 can comprise a coating of aluminum having a thickness of about 0.5 mils or about 13 microns. In many applications, signal performance benefits from a thickness that is greater than 2 mils, for example in a range of 2.0-2.5 mils, 2.0-2.25 mils, 2.25-2.5 mils, 2.5-3.0 mils, or 2.0-3.0 mils.

Each patch 175 can have a length of about 1.5 to 2 inches or about 4 to 5 centimeters. Other exemplary embodiments can have dimensions following any of these ranges, or some other values as may be useful. The dimensions can be selected to provide electromagnetic shielding over a specific band of electromagnetic frequencies or above or below a designated frequency threshold, for example.

In certain exemplary embodiments, each patch 175 has a length of about 2 meters, with the gaps between adjacent patches 175 about 1/16 of an inch. The resulting shield configuration provides a return loss spike in the operating band of the cable 100, which should be avoided by conventional thinking. However, the spike is unexpectedly suppressed, thereby providing an acceptable cable with segment and gap dimensions that offer manufacturing advantages. Thus, increasing the patch lengths benefits manufacturing while providing acceptable performance. The peak in return loss is surprisingly suppressed, and the cable 100 meets performance standards and network specifications.

In certain exemplary embodiments, each patch 175 covers a hole (not illustrated) in the dielectric substrate 150. In other words, the dielectric substrate 150 comprises holes or windows, with a patch 175 disposed over each hole or window. Typically, each patch 175 is slightly bigger than its associated window, so the patch 175 extends over the window edges. The windows eliminate a substantial portion of the flammable film substrate material, thereby achieving better burn characteristics, via producing less smoke, heat, and flame.

Turning now to FIG. 2C, this figure illustrates wrapping a segmented tape 125 lengthwise around a pair of conductors 105 according to certain exemplary embodiments of the present invention. Thus, FIG. 2C shows how the segmented tape 125 discussed above can be wrapped around or over one or more pairs of conductors 125 as an intermediate step in forming a cable 100 as depicted in FIG. 1A and discussed above. While FIG. 1A depicts four pairs of wrapped conductors 105, FIG. 2C illustrates wrapping a single pair 105 as an aid to visualizing an exemplary assembly technique.

As illustrated in FIG. 2C, the pair of conductors 105 is disposed adjacent the segmented tape 125. The conductors 105 extend essentially parallel with the major or longitudinal axis/dimension of the segmented tape 125. Thus, the conductors 105 can be viewed as being parallel to the surface or plane of the segmented tape 125. Alternatively, the conductors 105 can be viewed as being over or under the segmented tape 125 or being situated along the center axis of the segmented tape 125. Moreover, the conductors 105 can be viewed as being essentially parallel to one or both edges of the segmented tape 125.

In most applications the conductors 105, which are typically individually insulated, will be twisted together to form a twisted pair. And, the segmented tape 125 will wrap around the twisted pair as discussed below. FIG. 7A, discussed below, illustrates such an embodiment. In certain embodiments, multiple twisted pairs of conductors 105 will be twisted, bunched, or cabled together, with the segmented tape 125 providing a circumferential covering.

The long edges of the segmented tape 125 are brought up over the conductors 105, thereby encasing the conductors 105 or wrapping the segmented tape 125 around or over the conductors 105. In an exemplary embodiment, the motion can be characterized as folding or curling the segmented tape 125 over the conductors 105. As discussed above, the long edges of the segmented tape 125 can overlap one another following the illustrated motion.

In certain exemplary embodiments, the segmented tape 125 is wrapped around the conductors 105 without substantially spiraling the segmented tape 125 around or about the conductors. Alternatively, the segmented tape 125 can be wrapped so as to spiral around the conductors 105.

In one exemplary embodiment, the conductive patches 175 face inward, towards the conductors 105. In another exemplary embodiment, the conductive patches 175 face away from the conductors 105, towards the exterior of the cable 100.

In one exemplary embodiment, the segmented tape 125 and the conductors 105 are continuously fed from reels, bins, containers, or other bulk storage facilities into a narrowing chute or a funnel that curls the segmented tape 125 over the conductors 105.

In one exemplary embodiment, FIG. 2C describes operations in a zone of a cabling machine, wherein segmented tape 125 fed from one reel (not illustrated) is brought into contact with conductors 105 feeding off of another reel. That is, the segmented tape 125 and the pair of conductors 105 can synchronously and/or continuously feed into a chute or a mechanism that brings the segmented tape 125 and the conductors 105 together and that curls the segmented tape 125 lengthwise around the conductors 105. So disposed, the segmented tape 125 encircles or encases the conductors 105 in discontinuous, conductive patches.

Downstream from this mechanism (or as a component of this mechanism), a nozzle or outlet port can extrude a polymeric jacket, skin, casing, or sheath 115 over the segmented tape, thus providing the basic architecture depicted in FIG. 1A and discussed above.

Turning now to FIG. 3, this figure is a flowchart depicting a process 300 for manufacturing cable 100 according to certain exemplary embodiments of the present invention. Process 300 can produce the cable 100 illustrated in FIG. 1A using the segmented tape 125 and the conductors 105 as base materials.

At Step 305 an extruder produces a film of dielectric material, such as polyester, which is wound onto a roll or a reel. At this stage, the film can be much wider than the circumference of any particular cable in which it may ultimately be used and might be one to three meters across, for example. As discussed in further detail below, the extruded film will be processed to provide the dielectric substrate 150 discussed above.

At Step 310, a material handling system transports the roll to a metallization machine or to a metallization station. The material handling system can be manual, for example based on one or more human operated forklifts or may alternatively be automated, thereby requiring minimal, little, or essentially no human intervention during routine operation. The material handling may also be tandemized with a film producing station. Material handing can also comprise transporting materials between production facilities or between vendors or independent companies, for example via a supplier relationship.

At Step 315, the metallization machine unwinds the roll of dielectric film and applies a pattern of conductive patches 175 to the film. The patches 175 typically comprise strips that extend across the roll, perpendicular to the flow of the film off of the roll. The patches 175 are typically formed while the sheet of film is moving from a payoff roll (or reel) to a take-up roll (or reel). As discussed in further detail below, the resulting material will be further processed to provide multiple of the segmented tapes 125 discussed above.

In certain exemplary embodiments, the metallization machine can apply the conductive patches 175 to the dielectric substrate 150 by coating the moving sheet of dielectric film with ink or paint comprising metal. In one exemplary embodiment, the metallization machine can laminate segments of metallic film onto the dielectric film. Heat, pressure, radiation, adhesive, or a combination thereof can laminate the metallic film to the dielectric film.

In certain exemplary embodiments, flame retardant and/or smoke suppressant materials are incorporated into the segmented tape 125. A PVC color film or emulsion can be coated on patches 175 that comprise aluminum, for example. A flame retardant adhesive can be used to bond the patches 175 to the dielectric substrate 150.

In certain exemplary embodiments, the conductive patches 175 are attached to the dielectric substrate 150 with mechanical fasteners. Replacing an adhesive fastening system with a mechanical system can improve a cable's burn characteristics—producing less smoke, less flame, and less heat.

In certain exemplary embodiments each fastener comprises a hole extending through the dielectric substrate 150 and a conductive patch 175. The edges or periphery of the hole curl under to capture the two materials, in a "rivet effect" or a "peening effect." Each patch 175 can be attached to the dielectric substrate 150 with an array of such holes, each of which may be 0.25 to 2.0 millimeters in diameter, for example. An array of needles or pins can be thrust through each conductive patch 175 and the adjacent dielectric substrate 150, for example.

In certain exemplary embodiments, each fastener can comprise a staple, rivet, or pin that goes through a conductive patch 175 and the associated dielectric substrate 150. Such a fastener can be bent or flattened on opposite sides of the patch-substrate assembly so as to embrace the patch 175 and the dielectric substrate 150, thereby capturing the patch 175.

In certain exemplary embodiments, the fastener comprises an embossing. In this case, each patch 175 is pressed onto the dielectric substrate 150 with a roller that creates small indentations or corrugations. The indentations bind the two layers together, similar to the manner in which a two-ply napkin or tissue paper is held together.

In one exemplary embodiment, the metallization machine cuts a feed of pressure-sensitive metallic tape into appropriately sized segments. Each cut segment is placed onto the moving dielectric film and is bonded thereto with pressure, thus forming a pattern of conductive strips across the dielectric film.

In one exemplary embodiment, the metallization machine creates conductive areas on the dielectric film using vacuum deposition, electrostatic printing, or some other metallization process known in the art.

As discussed in further detail below with reference to FIGS. 4-7, in certain exemplary embodiments, the metallization machine applies conductive patches 175 to both sides of the film, so that conductive patches 175 on one film side cover un-patched areas on the other film side.

At Step 320, the material handling system transports the roll of film, which comprises a pattern of conductive areas or patches at this stage, to a slitting machine. At Step 325, an operator, or a supervisory computer-based controller, of the slitting machine enters a diameter of the core 110 of the cable 100 that is to be manufactured.

At Step 330, the slitting machine responds to the entry and moves its slitting blades or knives to a width corresponding to the circumference of the core 110 of the cable 100. As discussed above, the slitting width can be slightly less than the circumference, thus producing a gap around the conductor(s) or slightly larger than the circumference to facilitate overlapping the edges of the segmented tape 125 in the cable 100.

At Step 335, the slitting machine unwinds the roll and passes the sheet through the slitting blades, thereby slitting the wide sheet into narrow strips, ribbons, or tapes 125 that have widths corresponding to the circumferences of one or more cables 100. The slitting machine winds each tape 125 unto a separate roll, reel, or spool, thereby producing the segmented tape 125 as a roll or in some other bulk form.

While the illustrated embodiment of Process 300 creates conductive patches on a wide piece of film and then slits the resulting material into individual segmented tapes 125, that sequence is merely one possibility. Alternatively, a wide roll of dielectric film can be slit into strips of appropriate width that are wound onto individual rolls. A metallization machine can then apply conductive patches 175 to each narrow-width roll, thereby producing the segmented tape 125. Moreover, a cable manufacturer might purchase pre-sized rolls of the dielectric substrate 150 and then apply the conductive patches 175 thereto to create corresponding rolls of the segmented tape 125.

At Step 340, the material handling system transports the roll of sized segmented tape 125, which comprises the conductive patches 175 or some form of isolated segments of electrically conductive material, to a cabling system. The material handling system loads the roll of the segmented tape 125 into the cabling system's feed area, typically on a designated spindle. The feed area is typically a facility where the cabling machine receives bulk feedstock materials, such as segmented tape 125 and conductors 105.

At Step 345, the material handling system loads rolls, reels, or spools of conductive wires 105 onto designated spindles at the cabling system's feed area. To produce the cable 100 depicted in FIG. 1A as discussed above, the cabling system would typically use four reels, each holding one of the four pairs of conductors 105.

At Step 350, the cabling system unwinds the roll of the segmented tape 125 and, in a coordinated or synchronous fashion, unwinds the pairs of conductors 105. Thus, the segmented tape 125 and the conductors 105 feed together as they move through the cabling system.

A tapered feed chute or a funneling device places the conductors 105 adjacent the segmented tape 125, for example as illustrated in FIG. 2C and discussed above. The cabling system typically performs this material placement on the moving conductors 105 and segmented tape 125, without necessarily requiring either the conductors 105 or the segmented tape 125 to stop. In other words, tape-to-conductor alignment occurs on a moving steam of materials.

At Step 355, a curling mechanism wraps the segmented tape 125 around the conductors 105, typically as shown in FIG. 2C and as discussed above, thereby forming the core 110 of the cable 100. The curling mechanism can comprise a tapered chute, a narrowing or curved channel, a horn, or a contoured surface that deforms the segmented tape 125 over the conductors 105, typically so that the long edges of the segmented tape 125 overlap one another.

As will be discussed in further detail below with reference to FIG. 7, the conductive patches can be oriented so as to spiral in an opposite direction to pair and/or core twist of the cable 100.

At Step 360, an extruder of the cabling system extrudes the polymer jacket 115 over the segmented tape 125 (and the conductors 105 wrapped therein), thereby forming the cable 100. Extrusion typically occurs downstream from the curling mechanism or in close proximity thereof. Accordingly, the jacket 115 typically forms as the segmented tape 125, the conductors 105, and the core 110 move continuously downstream through the cabling system.

At Step 365, a take-up reel at the downstream side of the cabling system winds up the finished cable 100 in preparation for field deployment. Following Step 365, Process 300 ends and the cable 100 is completed. Accordingly, Process 300 provides an exemplary method for fabricating a cable comprising an electrically discontinuous shield that protects against electromagnetic interference and that supports high-speed communication.

Turning now to FIG. 4, this figure illustrates segmented tapes 400, 425, 475 comprising conductive patches 175A, 175B disposed on opposite sides of a dielectric substrate 150 according to certain exemplary embodiments of the present invention. The tapes 400, 425, and 475 are alternative embodiments to the segmented tape 125 discussed above with reference to FIGS. 1-3.

Figure 4A:
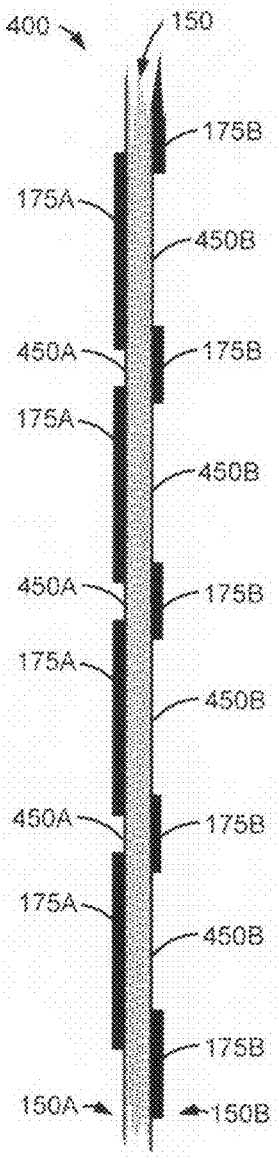
FIGS. 4A, 4B, and 4C, collectively

The tape 400 of FIG. 4A comprises conductive patches 175A attached to the tape side 150A with isolating spaces 450A between adjacent conductive patches 175A. In other words, the conductive patches 175A are separated from one another to avoid patch-to-patch electrical contact. Additional conductive patches 175B are disposed on the tape side 150B, and isolating spaces 450B likewise provide electrical isolation between and/or among those conductive patches 175B.

The conductive patches 175A on tape side 150A cover the isolating spaces 450B of tape side 150B. Likewise, the conductive patches 175B on tape side 150B cover the isolating spaces 450A of tape side 150A. In other words, the conductive patches 175A, 175B on one tape side 150A, 150B block, are in front of, are behind, or are disposed over the isolating spaces 450A, 450B on the opposite tape side 150A, 150B.

When the tape 400 is deployed in the cable 100 with overlapping or abutted tape edges, for example as discussed above with reference to FIG. 1A, the conductive patches 175A and 175B cooperate to fully circumscribe the pairs 105. That is, the pairs 105 are circumferentially covered and encased by the conductive areas of the conductive patches 175A and 175B. Such coverage blocks incoming and/or outgoing radiation from passing through the isolating spaces 450A and 450B.

Figure 4B:
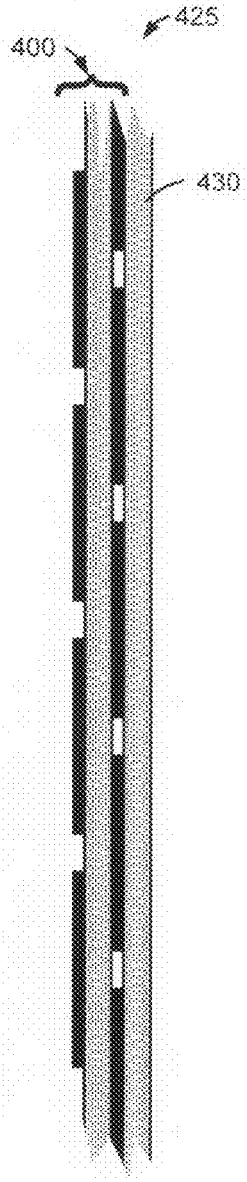

In the embodiment of FIG. 4B, a dielectric film 430 covers the tape side 150B of the tape 400. The resulting dielectric coating provides an electrically insulating barrier to avoid contact of the conductive patches 175B with one another or with the conductive patches 175A when the tape 425 is wrapped around the pairs 105.

Typically, the tape 425 is disposed in the cable 100 such that the exposed conductive patches 175A face away from the pairs 105, while the dielectric film 430 and the conductive patches 175B face towards the pairs 105. With this orientation, the conductive patches 175A can have a thickness of about 0.1 to 1.0 mils of aluminum, and the conductive patches 175B can have a thickness of about 1.0 to 1.6 mils of aluminum. In many applications, a thickness of at least 2 mils provides beneficial electrical performance. In other words, increasing shielding thickness to about 2 mils provides improved electrical performance. For example, the thickness can be in a range of 2-2.5 mils or 2-3 mils. Such geometry, dimension, and materials can provide shielding that achieves beneficial high-frequency isolation.

In an exemplary embodiment, the conductive patches 175A and the conductive patches 175B have substantially different thicknesses. In an exemplary embodiment, the conductive patches 175A and the conductive patches 175B have substantially different thicknesses and are formed of essentially the same conductive material.

In one exemplary embodiment, the conductive patches 175A are thicker than a skin depth associated with signals communicated over the cable 100. In one exemplary embodiment, the conductive patches 175B are thicker than a skin depth associated with signals communicated over the cable 100. In one exemplary embodiment, each of the conductive patches 175A and the conductive patches 175B is thicker than a skin depth associated with signals communicated over the cable 100.

The term "skin depth," as used herein, generally refers to the depth below a conductive surface at which an induced current falls to 1/e (about 37 percent) of the value at the conductive surface, wherein the induced current results from propagating communication signals in an adjacent wire or similar conductor. This term usage is intended to be consistent with that of one of ordinary skill in the art having benefit of this disclosure.

In certain exemplary embodiments, performance benefit results from making the conductive patches 175A and or the conductive patches 175B with a thickness of about three or more times a skin depth. In certain exemplary embodiments, performance benefit results from making the conductive patches 175A and or the conductive patches 175B with a thickness of at least two times a skin depth.

In an exemplary embodiment, the cable 100 carries signals comprising a frequency component of 100 MHz, and the skin depth is computed or otherwise determined based on such a frequency.

Figure 4C:
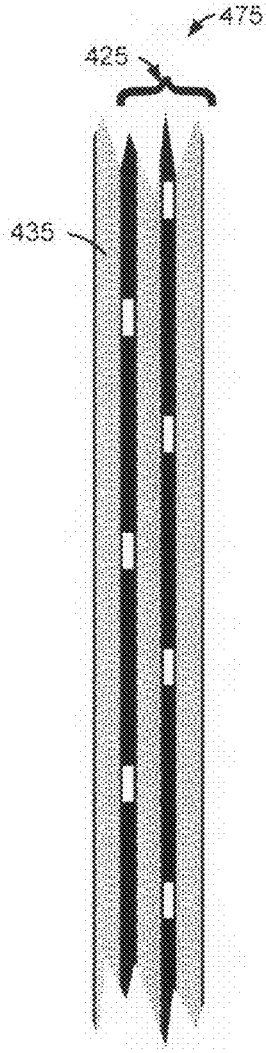

In the embodiment of FIG. 4C, another dielectric film 435 covers the tape side 150A of the tape 500. Thus, the dielectric film 435 insulates the conductive patches 175A from contact with one another (or some other electrical conductor) when the tape 475 is deployed in the cable 100 as discussed above.

Turning now to FIG. 5, this figure illustrates, from different viewing perspectives, a segmented tape 500 comprising conductive patches 175A, 175B disposed on opposite sides 150A, 150B of a dielectric substrate/film 150 according to certain exemplary embodiments of the present invention.

Figure 5A:
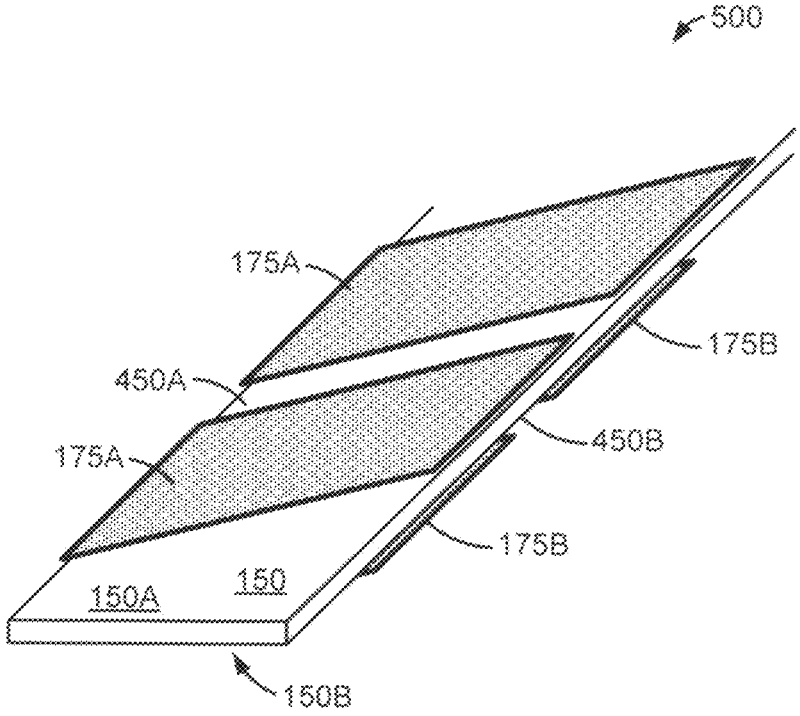
FIGS. 5A, 5B, 5C, and 5D, collectively
Figure 5B:
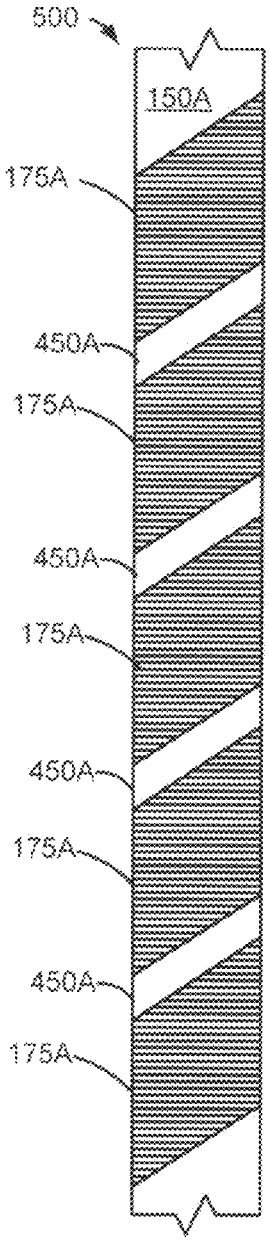
Figure 5C:
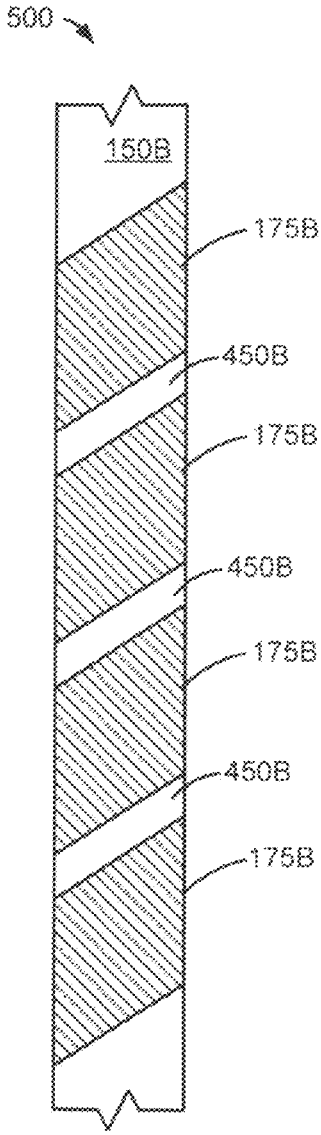
Figure 5D:
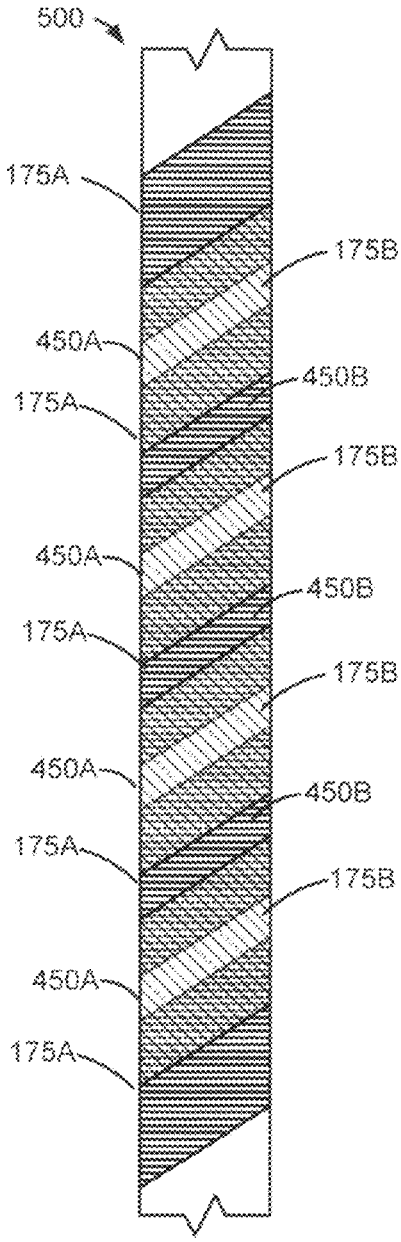

FIG. 5A illustrates a perspective view of the tape 500. FIG. 5B illustrates a view of the tape side 150A of the tape 500. FIG. 5C illustrates a view of the tape side 150B of the tape 500. FIG. 5D illustrates a view of the tape 500 in which both tape sides 150A and 150B are visible, as if the tape 500 was partially transparent. (The dielectric film 435 may be opaque, colored or transparent, while the conductive patches 175A, 175B may be visibly metallic, nonmetallic, opaque, or partially transparent.) Thus, FIG. 5D depicts the tape 500 as transparent to illustrate an exemplary embodiment in which the conductive patches 175A cover the isolating spaces 450B, and the conductive patches 175B cover the isolating spaces 450A.

In the exemplary embodiment that FIG. 5 illustrates, each of the conductive patches 175A and 175B has a geometric form of a parallelogram with two acute angles 600 (see FIG. 6) that are opposite one another and two obtuse angles 610 (see FIG. 6) that are opposite one another. The conductive patches 175A and the conductive patches 175B are oriented in the same longitudinal direction with respect to each other. Thus, along one edge of the tape 500, the acute corners (see FIG. 6 under reference number 600) of the patches 175A and the patches 175B point in the same tape direction.

In certain exemplary embodiments, the geometric form of the patches 175A is substantially different than the geometric form of the patches 175B. As compared to the patches 175A, the patches 175B can have a different number of sides, different side lengths, different angles, different surface area, etc.

In certain exemplary embodiments, at least one of the patches 175A and 175B is a square, a rectangle, or a parallelogram. In certain exemplary embodiments, at least one of the patches 175A and 175B comprises a geometric form having two acute angles.

In certain exemplary embodiments, each of the patches 175A is bonded to the tape side 150A with an adhesive that is applied not only under the patches 175A, but also on an area of the tape side 150A that is not covered with a patch 175A. Thus, the adhesive can be exposed in the isolating spaces 450A and/or in a strip running along the tape 500. For example, the patches 175A can be narrower than the tape side 150A such that an adhesive area extends along an edge of the tape 500, next to the patches 175A. Stated another way, the dielectric substrate 150/film provides an adhesive-coated substrate that is wider than the patches 175A to provide an adhesive strip running lengthwise along the tape 500. When the tape 500 is wrapped around a cable core or a group of twisted pairs, the adhesive binds the assembly closed. When curled around the cable core, the adhesive strip overlaps and adheres to the tape side 150A, like an adhesive-coated flap of an envelope that seals the envelope shut. A cable core formed in this manner is robust and can be transported between manufacturing operations for application of the polymer jacket 115.

Figure 6:
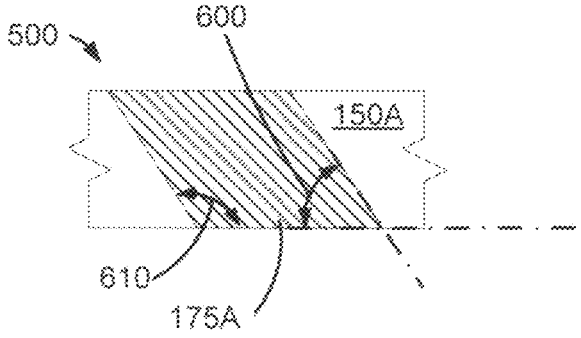
FIG. 6 is an illustration of an exemplary geometry for a conductive patch of a segmented tape in accordance with certain embodiments of the present invention.

Turning now to FIG. 6, this figure illustrates a geometry for a conductive patch 175A of a segmented tape 500 according to certain exemplary embodiments of the present invention. As illustrated in FIG. 6, the acute angle 600 facilitates manufacturing, helps the patches 175A and 175B cover the opposing isolating spaces 450A and 450B, and enhances patch-to-substrate adhesion.

The acute angle 600 results in the isolating spaces 450A and 450B being oriented at a non-perpendicular angle with respect to the pairs 105 and the longitudinal axis of the cable 105. If any manufacturing issue results in part of the isolating spaces 450A and 450B not being completely covered (by a conductive patch 175A, 175B on the opposite tape side 150A, 150B), such an open area will likewise be oriented at a non-perpendicular angle with respect to the pairs 105. Such an opening will therefore spiral about the pairs 105, rather than circumscribing a single longitudinal location of the cable 105. Such a spiraling opening is believed to have a lesser impact on shielding than would an opening circumscribing a single longitudinal location. In other words, an inadvertent opening that spirals would allow less unwanted transmission of electromagnetic interference that a non-spiraling opening.

In certain exemplary embodiments, benefit is achieved when the acute angle 600 is about 45 degrees or less. In certain exemplary embodiments, benefit is achieved when the acute angle 600 is about 35 degrees or less. In certain exemplary embodiments, benefit is achieved when the acute angle 600 is about 30 degrees or less. In certain exemplary embodiments, benefit is achieved when the acute angle 600 is about 25 degrees or less. In certain exemplary embodiments, benefit is achieved when the acute angle 600 is about 20 degrees or less. In certain exemplary embodiments, benefit is achieved when the acute angle 600 is about 15 degrees or less. In certain exemplary embodiments, benefit is achieved when the acute angle 600 is between about 12 and 40 degrees. In certain exemplary embodiments, the acute angle 600 is in a range between any two of the degree values provided in this paragraph.

Turning now to FIG. 7A, this figure illustrates an orientation for conductive patches 175B of a segmented tape 500 with respect to a twisted pair 105 of conductors according to certain exemplary embodiments of the present invention. The pair 105 has a particular twist direction 750 (clockwise or counter clockwise) known as a twist lay. That is, the pair 105 may have a "left hand lay" or a "right hand lay."

When the tape 500 is wrapped around the pair 105 as illustrated in FIG. 2C and discussed above, the conductive patches 175B spiral about the pair in a direction that is opposite the twist lay. That is, if the pair 105 is twisted in a counterclockwise direction, the conductive patches 175B (as well as the conductive patches 175A and the isolating spaces 450A and 450B) spiral in a clockwise direction. If the pair 105 is twisted in a clockwise direction, the conductive patches 175B (as well as the conductive patches 175A and the isolating spaces 450A and 450B) spiral in a counterclockwise direction.

With this rotational configuration, the edges of the conductive patches 175B that extend across the tape 500 tend to be more perpendicular to each of the individually insulated conductors of the pair 105, than would result from the opposite configuration. In most exemplary embodiments and applications, this configuration can provide an enhanced level of shielding performance.

In exemplary embodiments, each of the conductive patches 175B is substantially longer than the twist length of the twisted pair 105. In certain exemplary embodiments, each conductive patch 175B has a length that substantially deviates from an integer multiple of the twisted pair's twist length.

Figure 7B:
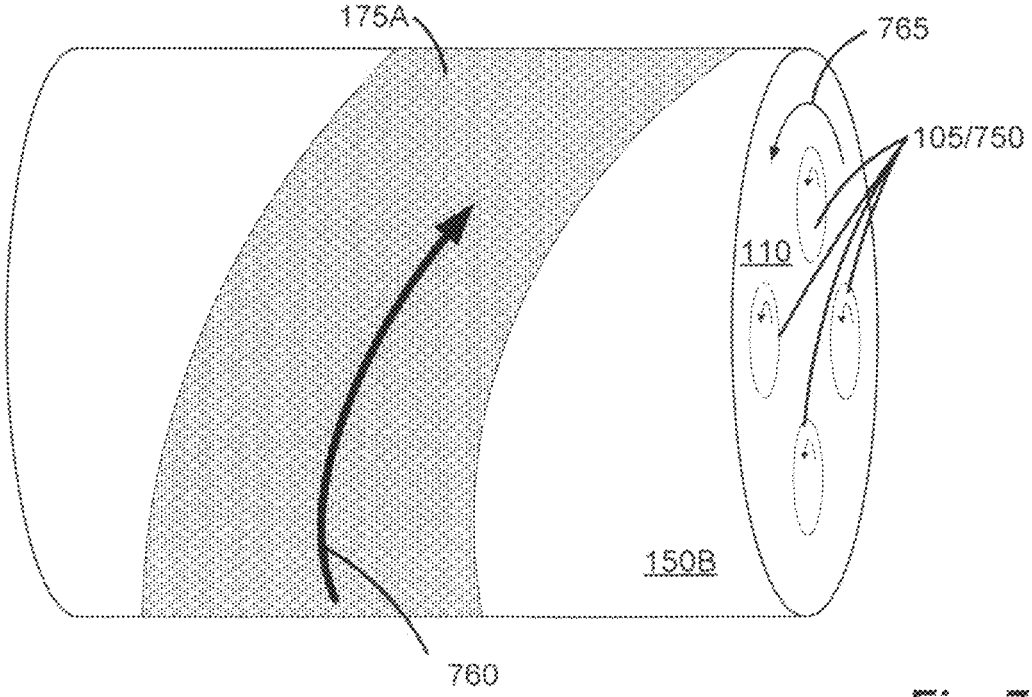
FIG. 7B is an illustration of a core of a communication cable comprising conductive patches disposed in an exemplary geometry with respect to a twist direction of twisted pairs and to a twist direction of the cable core in accordance with certain embodiments of the present invention.

Turning now to FIG. 7B, this figure illustrates a core 110 of a communication cable 100 comprising conductive patches 175A disposed in a particular geometry with respect to a twist direction 750 of twisted pairs 105 and to a twist direction 765 of the cable core 110 according to certain exemplary embodiments of the present invention.

As discussed above with reference to FIG. 7A, the conductive patches 175A and 175B have a spiral direction 760 that is opposite the twist direction 750 of the pairs. In the illustrated exemplary embodiment, the core 110 of the cable 100 is also twisted. That is, the four twisted pairs 105 are collectively twisted about a longitudinal axis of the cable 100 in a common direction 765. The twist direction 765 of the core 110 is opposite the spiral direction of the conductive patches 175A. That is, if the core 110 is twisted in a clockwise direction, then the conductive patches 175A spiral about the core 110 in a counterclockwise direction. If the core 110 is twisted in a counterclockwise direction, then the conductive patches 175A spiral about the core 110 in a clockwise direction. Thus, cable lay opposes the direction of the patch spiral. In many exemplary embodiments and applications, this configuration can provide an enhanced level of shielding performance.

Turning now to FIGS. 8A, 8B, 9A, 9B, and 9C, exemplary segmented tape geometries will be described that offer manufacturing advantages while managing return loss to an acceptable level or reducing return loss. FIG. 8A illustrates a segmented tape 800 having such a geometry according to certain exemplary embodiments of the present invention. FIG. 8B illustrates a segmented tape 800B in which metallization has been applied to the dielectric substrate 150. FIG. 9A illustrates a plot 900 of return loss as a function of frequency for a cable 100 incorporating the segmented tape 800 of FIG. 8A according to certain exemplary embodiments of the present invention. FIGS. 9B and 9C illustrate return loss graphs 901, 904 for exemplary cables according to certain embodiments of the present invention.

Referring to FIG. 8A, the segmented tape 800 comprises patches 175C separated by isolating spaces 450C to provide an electrically discontinuous shield. In many circumstances, lengthening the patches 175C provides manufacturing advantages. With longer patches 175C, the manufacturing process can be implemented with fewer patches 175C, and tolerances for patch placement may be relaxed. Thus, fabrication of the tape 800 can be simplified via using a smaller number of patches 175C, with each having a length 825 that is longer or extended.

With longer patches 175C, the length 875 of each of the isolation spaces 450A can also be increased since the resulting tape 800 has fewer isolation spaces 450A through which radiation can pass. In other words, lengthening the patches 175C leads to few isolation spaces 450A transmitting interference to or from the conductor pairs 105; thus each isolation space 450A can be bigger. Reducing the number of isolation spaces 450A and increasing the length 875 of each space 450A further relaxes manufacturing tolerances for patch placement.

In certain exemplary embodiments, each patch 175C adheres directly to tape side 150A of the dielectric substrate 150 without an intermediate material layer between the dielectric substrate 150 and the patches 175C other than an adhesive. Alternatively, the tape side 150A of the dielectric substrate 150 can be coated with an electrically conductive material or electrically resistive material to produce a desired electrical interaction between or among the patches 175C. FIG. 8B, which will be discussed in further detail below, illustrates such an embodiment, wherein the dielectric substrate 150 has been coated with a thin layer of metal 810.

Referring to FIG. 8A, in certain exemplary embodiments, the patches 175C interact with signals flowing on the conductor pairs 105 (illustrated in FIG. 1A) in a collaborative manner involving multi-patch or patch-to-patch interaction. For example, an electric, magnetic, or electromagnetic field (or energy associated therewith) of one or more patches 175C can accumulate with, affect, or interact with an electric, magnetic, or electromagnetic field (or energy associated therewith) of one or more other patches 175C. Thus, energy and/or fields can accumulate or transfer between or among patches 175C.

Further, a standing wave can set up on the patches 175C, and/or the patches 175C can set up a standing wave impacting signals propagating through the conductor pairs 105. That is, the patches 175C can resonate with one another or create a resonance impacting signal transmission on the conductor pairs 105.

In certain exemplary embodiments, a signal transmitting over a conductor pair 105 comprises multiple frequencies. Each signal frequency produces an associated electromagnetic field that extends outward from the conductors of the pair 105 and that varies according to signal frequency. The varying electromagnetic field interacts with the patches 175C. With the patches 175C having substantially uniform lengths 825 and separated by substantially uniform isolation spaces 450A, the patches 175C can collectively interact with the electromagnetic fields in a manner that produces a cumulative interaction for certain signal frequencies. This cumulative interaction or resonance can, thereby, reflect specific signal frequencies more than other signal frequencies. This frequency-specific reflection can manifest itself as a peak or spike 975 in return loss as illustrated in FIG. 9A and further discussed below.

In an alternative explanation, digital communication involves transmitting pulses or signals having sharp (rapidly increasing and decreasing) edges, often resembling a square wave when viewed on an instrument such as an oscilloscope. The signal edges or pulses comprise multiple signal frequencies. As the signals transmit over the cable 100, each signal frequency interacts with and may be slightly reflected by each patch edge encountered, each patch 175C encountered, and/or each isolation space 450A encountered. These slight reflections and/or interactions can accumulate for specific signal frequencies matching the physical dimensions of the pattern of patches 175C and isolation spaces 450A of the segmented tape 800. For example, the patches may be disposed on the segmented tape 800 in a pattern that repeats over the length 850 that represents one repetitive cycle in the patch pattern. Thus, the reflections add for signal frequencies that correlate with the length 850 or period of the segmented tape's pattern of patches. This frequency-specific addition of signal reflection produces the return loss spike 975 illustrated in FIG. 9A.

One option for addressing the return loss spike 975 is to shorten the patches 175C to move the spike 975 to a frequency above the cable's operating frequency range. However, as discussed above, lengthening the patches 975C is desirable from a manufacturing perspective. Another issue with shortening the patches 975C and pushing the return loss spike 975 towards a higher frequency stems from impairment of the cable's high-frequency performance. The higher signal frequencies can support faster data rates and can provide signals with sharper edges for beneficial signal detection.

The applicants have found that the cable 100 can provide acceptable return loss performance with the patches 175 having a length 825 in a range of about one to ten meters and isolation spaces 450 in a range of about one to five millimeters. Moreover, the cable 100, or a particular conductor pair 105 thereof, can meet a return loss performance specification for communication in a range of about 0.5 to about 15 Gigabits per second. In various exemplary embodiments, the patches 175C can have a length 825 of about 0.5, 0.75, 1.0, 1.5, 2.0, 2.5, 3.0, 3.5, 4.0, 4.5, or 5.0 meters or in a range between any two of these values; and the isolation spaces 450 can have a length 875 of about 0.5, 1.0, 1.5, 2.0, 2.5, 3.0, 3.5, or 4 millimeters or in a range between any two of these values.

In one exemplary embodiment, each patch 175C has a length of about 1.5 meters and the isolation spaces 450 provide patch-to-patch gaps of about 1.5 millimeters each. Each such patch 175C is applied to the tape side 150A as illustrated in FIG. 8A. Additionally, patches 175B having a length of about 5 centimeters are applied to the tape side 150B to cover the isolation spaces 450 as illustrated in FIG. 5 and discussed above.

As shown in the plot 900 of FIG. 9A, which presents representative performance rather than actual testing data, the return loss spike 975 is located in an operating frequency of the cable 100. In various exemplary embodiments, the operating frequency can comprise (or consist of) a frequency range that is greater than 25, 50, 75, or 100 Megahertz and/or lower than 200, 250, 300, 350, 400, or 450 Megahertz or in a range between any two of the frequency values provided in this sentence. The illustrated exemplary trace 950 of return loss is below the illustrated specification limit 925, which exemplifies a specification that may be issued, published, or required by a manufacturer, a customer, a government agency, or a industry standard. In other words, the return loss complies with the specification limit 925 and is better than the specification limit 925. Furthermore, the magnitude of the return loss spike 975 is suppressed so as to avoid violating the exemplary specification limit 925. In various exemplary embodiments, the return loss spike 925 peaks below 10, 14, 15, 17, 20, or 25 decibels, or in a range between any two of these values. This range, like all other examples, ranges, and values given in this disclosure, is provided as an example and is intended to be representative rather than limiting.

Additionally, various exemplary segmented tape embodiments can be deployed in a horizontal cable, a flexible cable, an equipment cord, a cross-connect cord, a plenum cable, a riser cable, or another appropriate communication cable. Accordingly, embodiments of the cable 100 discussed above can be configured as a horizontal cable, a flexible cable, an equipment cord, a cross-connect cord, a plenum cable, a riser cable, or another appropriate communication cable. Flexible cables are compatible with use as equipment cords, cross-connect cords, and work area cords. The term "horizontal cable," as used herein, generally refers to a communication cable that is intended for horizontal indoor deployment in non-plenum applications. Horizontal cables are typically distinct from plenum or riser cables.

FIGS. 9B and 9C illustrate simulated return loss graphs 901, 904 for exemplary cables 100 in accordance with certain embodiments of the present invention. FIG. 9B illustrates return loss as a function of frequency for Category 6/6A horizontal and flexible cables, with the plot 902 representing a horizontal cable and the plot 903 representing a flexible cable. FIG. 9C illustrates return loss as a function of frequency for Category 7/7A horizontal and flexible cables, with the plot 905 representing a horizontal cable and the plot 906 representing a flexible cable.

Turning now to FIG. 8B, this figure illustrates a segmented tape 800B in which the dielectric substrate 150 is coated with a thin layer of metal 810. The patches 175C are disposed on top of the thin layer of metal 810 and may be held in place by an adhesive 811. Thus, the thin layer of metal 810 extends across the isolation spaces 450 and under each of the patches 175C.

In certain exemplary embodiments, the thin layer of metal 810 comprises aluminum, an aluminum alloy, copper, or some other appropriate metal. Other materials that conduct electricity or exhibit electrical resistance, including carbon-based materials and semiconductors, can be substituted for metal. In certain exemplary embodiments, the thin layer of metal 810 and the associated patches 175C have like compositions, for example both being aluminum. In many applications, benefit is achieved by selecting metals that avoid galvanic interaction. However, in certain exemplary embodiments, the compositions of the thin layer of metal 810 and the patches 175C differ.

In an exemplary embodiment, the adhesive 811 allows some leakage of electricity between the patches 175C and the thin layer of metal 810. In such an embodiment, the adhesive 811 under each patch 175C can operate as a high-ohm resistor between its associated patch 175C and the thin layer of metal 810. Accordingly, each patch 175C is in electrical communication with the thin layer of metal 810 and with other patches 175C. In one exemplary embodiment, the adhesive 811 can be an ionic glue. Suitable adhesives for the adhesive 811 that are partially conductive are available from Master Bond, Inc. of Hakensack, N.J. and from Engineered Conductive Materials, LLC of Delaware, Ohio. In one exemplary embodiment, the adhesive 811 comprises a conductive material that is commercially available for RFID antenna bonding, such as the product that Engineered Conductive Materials designates "CI-1001."

In an exemplary embodiment, the dielectric substrate 150 comprises a strip of polyester film such as the material sold by E.I. DuPont de Nemours and Company under the registered trademark MYLAR. Aluminized films made from this polyester product are widely available commercially with various thicknesses of aluminum, typically applied via vapor deposition. With such materials, the thin layer of metal 810 can be sufficiently thin to have a resistance of about 1,000 ohms per linear meter. In other words, after metallization, a one-meter length of the dielectric substrate 150 can have an electrical resistance of about 1 Kilo ohm. In various exemplary embodiments, the resistance can be 0.25, 0.5, 1, 1.25, 1.5, 1.75, 2, 2.5, 4, 5, 7, or 10 Kilo ohms per meter or in a range between any two of the values described in this sentence, or can have some other appropriate value, for example.

In an exemplary embodiment, the resistance between adjacent patches can be about 1,000, 2,000, 3,000, 4000, or 5,000 ohms or in a range between any two of the values described in this sentence. In one exemplary embodiment, the patch-to-patch resistance can be between about 1,000 and 5,000 ohms. The patch-to-patch resistance results from a resistive electrical path that can comprise a combination of the resistances of the adhesive 811, the thin metal layer 810, and the patches 175C (which typically have high conductivity and thus very low resistance).

In certain exemplary embodiments, the segmented tape 800B comprises a resistive electrical path having a resistance of between 100 Kilo ohms and 100 Mega ohms between opposite ends of a cable 100 as cut to length for installation or as spooled for shipment.

Without being bound by theory, the thin layer of metal 810 is believed to enhance electrical performance via supporting a weak current drainage. The thin layer of metal can diminish crosstalk and electrical reflections, resulting in less noise and better return loss performance.

Those of skill in the art having benefit of this disclosure will appreciate that the thin metal film 810 can be applied across the embodiments of shields, shielding tapes, segmented tapes, and other appropriate devices and systems disclosed herein, including those described in the documents incorporated by reference. In other words, the present teaching supports applying the technology represented in FIG. 8B to a wide range of cables and cable shields, including those described herein in detail.

In certain exemplary embodiments, the thin metal film 810 is applied to an intermediate tape (not illustrated) that is disposed between the dielectric substrate 150 and the patches 175C. In certain exemplary embodiments, the thin metal film 810 is applied to a separate tape (not illustrated) that is disposed over the patches 175C, such that the patches 175C are sandwiched between that separate tape and the dielectric substrate 150. In either case, an electrically resistive path running along the separate tape can connect the patches 175C to one another.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

a plurality of pairs of individually insulated electrical conductors for transmitting communication signals within a frequency range;

a tape wrapped around at least one pair of the plurality of pairs of individually insulated electrical conductors, the tape comprising electrically conductive patches that are electrically isolated from one another and that are longitudinally separated from one another, the electrically conductive patches each having a length between approximately one meter and approximately three meters to result in a spike in return loss within the frequency range; and a jacket circumferentially covering the tape.

2. The communication cable of claim 1, wherein the spike in return loss is better than 20 decibels and results from resonance among the electrically conductive patches.

3. The communication cable of claim 1, wherein the spike in return loss is better than 20 decibels at a frequency below 500 Megahertz, and wherein the electrically conductive patches are operative to create a standing wave producing the spike in return loss.

4. The communication cable of claim 1, wherein the spike in return loss is below 200 Megahertz and results from a size and pattern of the electrically conductive patches.

5. The communication cable of claim 1, wherein the spike in return loss peaks at better than 25 decibels for a frequency in a range between 25 and 200 Megahertz.

6. The communication cable of claim 1, wherein the length of each of the electrically conductive patches is at least about two meters.

7. The communication cable of claim 1, wherein at least two of the patches are separated by a gap of at least about one and one half millimeters.

8. The communication cable of claim 1, wherein the tape circumscribes the plurality of pairs of individually insulated conductors, wherein the electrically conductive patches are disposed on a first side of the tape and are longitudinally separated from one another by gaps, and wherein second electrically conductive patches are disposed on a second side of the tape to cover the gaps.

9. The communication cable of claim 1, wherein the tape is disposed between two pairs of the plurality of pairs of individually insulated conductors.

10. The communication cable of claim 1, wherein a respective second tape is disposed circumferentially around each of the plurality of pairs of individually insulated electrical conductors.

11. The communication cable of claim 1, further comprising a second tape circumferentially disposed around the plurality of pairs of individually insulated electrical conductors.

12. The communication cable of claim 1, wherein the length of each of the electrically conductive patches is approximately equal.

13. A communication cable, comprising:

at least four twisted pairs of insulated electrical conductors;

an electromagnetic shield circumscribing the at least four pairs and comprising:

a strip of dielectric film comprising first and second edges extending lengthwise along the communication cable; and;

a plurality of electrically conductive film segments disposed on the strip of dielectric film, each segment between about one meter and about three meters in length, each segment disposed on the strip of dielectric film at a different longitudinal location, with at least about one millimeter of separation between adjacent segments; and a jacket circumscribing the shield.

14. The communication cable of claim 13, wherein the plurality of electrically conductive film segments are collectively operative to produce a peak in return loss within an operating frequency range of the communication cable.

15. The communication cable of claim 14, wherein the peak is suppressed to avoid violating a return loss performance specification.

16. The communication cable of claim 13, wherein each of the separations is at least 2.5 millimeters.

17. The communication cable of claim 13, wherein the communication cable is operative to transmit digital communication signals effectively at a data rate of at least about ten Gigabits per second, and wherein the electromagnetic shield is operative to produce a return loss peak for at least one of the four twisted pairs within an operating frequency of the transmitted digital communication signals.

18. The communication cable of claim 13, wherein the communication cable is operative to carry effective digital communication signals at a data rate of at least about ten Gigabits per second, and wherein the plurality of electrically conductive film segments are collectively operative to produce a return loss peak for the communication cable via resonance, the return loss peak occurring at less than 500 Megahertz and having a maximum value that is better than about 25 decibels.

19. The communication cable of claim 13, wherein the plurality of electrically conductive film segments are operative to interact with one another via transferring electromagnetic energy among one another to create a resonant peak in return loss for the communication cable at a frequency of less than 500 Megahertz.

20. The communication cable of claim 13, wherein each segment has an approximately equal length.

21. A communication cable, comprising:

a plurality of electrical conductors for transmitting digital communication signals comprising a range of frequencies;

a ribbon, comprising electrically insulating material, disposed alongside at least one of the plurality of electrical conductors;

a plurality of metallic patches disposed on the ribbon with isolation regions separating the metallic patches from one another, the plurality of metallic patches each having a length between approximately one meter and approximately three meters; and a jacket covering the electrical conductors, the ribbon, and the plurality of metallic patches.

22. The communication cable of claim 21, wherein the plurality of metallic patches produce a peak in return loss for a frequency within the range of frequencies via resonance.

23. The communication cable of claim 22, wherein the resonance occurs below about 300 Megahertz and the peak is suppressed to better than about fifteen decibels.

24. The communication cable of claim 23, wherein the digital communication signals are in a range of about 0.9 Gigabits per second to about 15 Gigabits per second for an associated pair of the conductors, and wherein the communication cable further comprises a second plurality of metallic patches disposed on a side of the ribbon opposite the plurality of metallic patches, and wherein each patch in the second plurality of metallic patches is adjacent a respective one of the isolation regions.

25. The communication cable of claim 21, wherein the length of each of the plurality of metallic patches is approximately equal.

26. The communication cable of claim 21, wherein the ribbon is circumferentially disposed about at least one of the plurality of electrical conductors.

27. A communication cable comprising:

a plurality of individually insulated electrical conductors extending lengthwise for transmitting communication signals within a frequency range;

an outer jacket extending lengthwise; and a shield, extending lengthwise between the outer jacket and the plurality of individually insulated electrical conductors, the shield comprising:

an electrically insulating substrate; and a plurality of electrically conductive patches each having a length between approximately one meter and approximately three meters, the patches disposed on the substrate and separated from one another, wherein adjacent electrically conductive patches are electrically connected through a resistive electrical path, and wherein each of the electrically conductive patches is dimensioned to produce a peak in return loss for a frequency within the frequency range.

28. The communication cable of claim 27, wherein the adjacent electrically conductive patches have about one thousand to five thousand ohms of electrical resistance between one another.

29. The communication cable of claim 27, wherein the resistive electrical path comprises a metal film disposed between the plurality of electrically conductive patches and the electrically insulating substrate.

30. The communication cable of claim 27, wherein the electrically insulating substrate comprises a metallized tape.

31. The communication cable of claim 27, wherein the shield has a longitudinal resistance of about 100 Kilo ohms to about 100 Mega ohms per meter.

32. The communication cable of claim 27, wherein the electrically insulating substrate comprises a metal coating providing a resistance in a range of about 100,000 ohms to about 100,000,000 ohms.

33. The communication cable of claim 27, wherein the shield comprises an electrically conductive material coated on the electrically insulating substrate, and wherein an ionic glue attaches each patch in the plurality of electrically conductive patches to the electrically conductive material.

34. The communication cable of claim 27, wherein the shield circumscribes the plurality of individually insulated electrical conductors.

35. The communication cable of claim 27, wherein the length of each of the electrically conductive patches is approximately equal.

36. A communication cable comprising:

a plurality of pairs of individually insulated electrical conductors, operative to transmit digital signals along the communication cable; and a tape circumferentially disposed about the plurality of pairs of individually insulated electrical conductors, the tape comprising:

a dielectric substrate having a metallic coating on at least one side; and a plurality of electrically conductive patches adhering to the metallic coating and longitudinally separated from one another, each of the electrically conductive patches having a length between approximately one meter and approximately three meters to produce a spike in return loss within an operating range of the communication cable.

37. The communication cable of claim 36, wherein ionic glue adheres the plurality of electrically conductive patches to the metallic coating.

38. The communication cable of claim 36, wherein the tape is operative to shield at least one of the plurality of pairs of individually insulated electrical conductors from interference.

39. The communication cable of claim 36, wherein the metallic coating provides resistance between adjacent electrically conductive patches.

40. The communication cable of claim 36, wherein the length of each of the electrically conductive patches is approximately equal.

41. A communication cable comprising:

a plurality of twisted pairs of electrical conductors that extend longitudinally;

a strip of dielectric film disposed alongside the plurality of twisted pairs and comprising a metalized surface that extends longitudinally; and a plurality of conductive film segments, each adhering to the metalized surface at a different longitudinal location and comprising a length between approximately one meter and approximately three meters.

42. The communication cable of claim 41, wherein the strip of dielectric material and the plurality of conductive film segments form a segmented shield.

43. The communication cable of claim 41, wherein the metalized surface is operative to provide a selected level of resistance between longitudinally adjacent conductive film segments.

44. The communication cable of claim 41, wherein the length of each of the conductive film segments is approximately equal.

* * * * *